US007370455B2

(12) United States Patent
Dewey et al.

(10) Patent No.: US 7,370,455 B2
(45) Date of Patent: May 13, 2008

(54) FOOD CONTAINER SEALING APPARATUS

(75) Inventors: Kevin J. Dewey, Walker, MI (US); Donald J. Van Weelde, Grand Rapids, MI (US); James A. Van Doorne, Rockford, MI (US)

(73) Assignee: Oliver Products Company, Grand Rapids, MI (US)

( * ) Notice: Subject to any disclaimer, the term of this patent is extended or adjusted under 35 U.S.C. 154(b) by 0 days.

(21) Appl. No.: 10/567,885

(22) PCT Filed: Aug. 18, 2005

(86) PCT No.: PCT/US2005/029363

§ 371 (c)(1),
(2), (4) Date: Feb. 9, 2006

(87) PCT Pub. No.: WO2006/023626

PCT Pub. Date: Feb. 3, 2006

(65) Prior Publication Data

US 2007/0107379 A1 May 17, 2007

(51) Int. Cl.
*B65B 51/14* (2006.01)
*B65B 67/02* (2006.01)

(52) U.S. Cl. ..... 53/329.3; 53/390

(58) Field of Classification Search ..... 53/329.3, 53/329.5

See application file for complete search history.

(56) References Cited

U.S. PATENT DOCUMENTS

| | | | | |
|---|---|---|---|---|
| 2,078,314 | A * | 4/1937 | Busche | 53/329.5 |
| 3,378,991 | A * | 4/1968 | Anderson | 53/329.3 |
| 3,392,506 | A * | 7/1968 | Haines | 53/329.3 |
| 3,937,645 | A * | 2/1976 | Ascoli et al. | 156/522 |
| 5,930,977 | A * | 8/1999 | Hsu | 53/329.5 |
| 5,946,887 | A * | 9/1999 | Lastovich et al. | 53/329 |
| 6,499,271 | B1 * | 12/2002 | Lastovich et al. | 53/329.2 |
| 6,681,546 | B2 * | 1/2004 | DeYoung et al. | 53/329.2 |

* cited by examiner

*Primary Examiner*—John Sipos
(74) *Attorney, Agent, or Firm*—Price, Heneveld, Cooper, DeWitt & Litton

(57) ABSTRACT

An apparatus is disclosed for sealing food containers using a sealing film. The apparatus includes a base, a container holder for holding a food container; a heater platen positioned within the base, and a pressure applicator positioned on a surface of the heater platen, the pressure applicator applies pressure to the heater platen causing the heater platen to move into engagement with the sealing film to thereby seal the sealing film to portions of the food container.

52 Claims, 25 Drawing Sheets

FOOD CONTAINER SEALING APPARATUS

FIELD OF THE INVENTION

The present invention generally relates to an apparatus for sealing food containers, and more specifically pertains to an apparatus for sealing food containers with a sealing film.

BACKGROUND OF THE INVENTION

Various forms of apparatus are known in the prior art for sealing food containers. The following commonly assigned patents disclose various forms of tray sealing machines including machines that are automated or manual: U.S. Pat. Nos. 5,784,858; 5,946,887; 6,499,271; 6,571,534; and 6,681,546. The machines disclosed in these U.S. patents are very effective at sealing food trays. However, there exists the need for a food container apparatus that is cheaper and easier to manufacture so as to be priced at a level so as to be economically attractive to a larger group of consumers.

SUMMARY OF THE INVENTION

A first aspect of the present invention is to provide an apparatus for sealing food containers using a sealing film. The apparatus comprises a base and a container holder for holding a food container, with the container holder being configured to be moved relative to the base between a loading position and a sealing position. The apparatus also includes a heater platen positioned within the base and a handle rotatably attached to the base to rotate between a loading position and a sealing position, with the handle having a cam within the base. The apparatus further includes a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position.

Another aspect of the present invention is to provide an apparatus for sealing food containers using a sealing film. The apparatus comprises a base and a container holder for holding a food container, with the container holder being configured to hold a roll of the sealing film such that a portion of the sealing film may be unrolled and pulled over the food container. The apparatus also includes a heater platen positioned within the base and a pressure applicator positioned on a surface of the heater platen wherein the pressure applicator applies pressure to the heater platen causing the heater platen to move into engagement with the sealing film to thereby seal the sealing film to portions of the food container.

Yet another aspect of the present invention is to provide an apparatus for sealing food containers using a sealing film. The apparatus comprises a base, a container holder for holding a food container, and a heater platen positioned within the base. The apparatus further includes a pressure applicator positioned on a surface of the heater platen, wherein the pressure applicator applies pressure to the heater platen causing the heater platen to move into engagement with the sealing film to thereby seal the sealing film to portions of the food container. The apparatus also includes a cutting blade mounted in front of the heater platen for cutting the sealing film.

In another aspect of the present invention, an apparatus for sealing food containers using a sealing film is provided. The apparatus comprises a base and a container holder for holding a food container, with the container holder being configured to be moved relative to the base between a loading position and a sealing position. The apparatus also includes a heater platen positioned within the base and a pressure applicator positioned on the heater platen wherein the pressure applicator applies pressure to the heater platen causing the heater platen to move into engagement with the sealing film to thereby seal the sealing film to portions of the food container when the container holder is in the sealing position, wherein the pressure applicator includes a resilient member for applying resilient pressure to the heater platen.

Another aspect of the present invention is to provide an apparatus for sealing food containers using a sealing film. The apparatus comprises a base comprising a front panel, a rear panel, and two opposing substantially vertical side panels extending between the front panel and the rear panel. The apparatus also includes a container holder for holding a food container, with the container holder being configured to be moved relative to the base between a loading position and a sealing position and with the container holder having a pair of side edges. The apparatus further includes a heater platen positioned within the base, a pair of guides extending vertically from opposite sides of the heater platen, and a handle movably attached to the base to move between a loading position and a sealing position. The apparatus also includes a pressure applicator positioned on a surface of the heater platen whereby as the handle is moved, the handle causes the pressure applicator to apply pressure to a central portion of the heater platen causing the heater platen to move into engagement with the sealing film to thereby seal the sealing film to portions of the food container when the container holder is in the sealing position. The side panels of the base each have elongated opposing first grooves on inner surfaces thereof, the first grooves extending substantially horizontally and opening to a front of the base to receive the side edges of the container holder such that the container holder is horizontally slidable within the base, the side panels of the base each also having elongated opposing second grooves on inner surfaces thereof, the second grooves extending substantially vertically to receive the guides such that the guides and the heater platen are vertically movable within the base above the container holder.

Yet another aspect of the present invention is to provide a container holder for an apparatus for sealing food containers using a sealing film. The container holder comprises a plate having at least one opening therethrough, with the plate being configured to support a food container thereon whereby pockets in the food container are accepted within the at least one opening. The container holder further includes legs extending downwardly from the plate for supporting the plate above a surface and a film holder associated with the plate to hold a roll of the sealing film such that a portion of the sealing film may be unrolled and pulled over the food container placed on the plate. The container holder also includes a cutting device connected to the plate for cutting the sealing film.

These and other features, advantages and objects of the present invention will be further understood and appreciated by those skilled in the art by reference to the following specification, claims and appended drawings.

DETAILED DESCRIPTION OF THE PREFERRED EMBODIMENTS

Figure 1A:
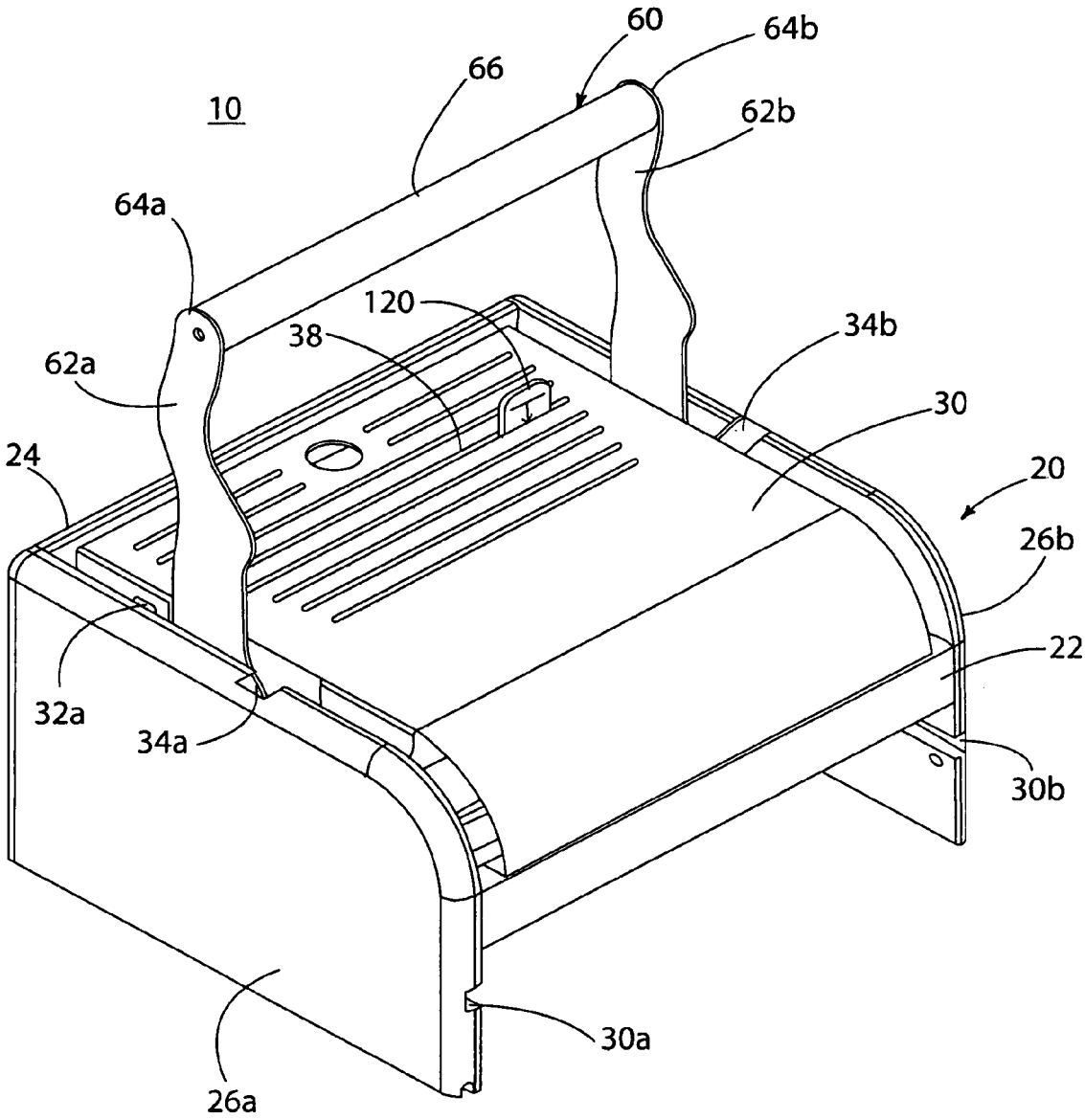
FIG. 1A is a perspective view of a first embodiment of the apparatus of the present invention with the handle in the loading position.

For purposes of description herein, the terms "upper," "lower," "right," "left," "rear," "front," "vertical," "horizontal," "top," "bottom," and derivatives thereof shall relate to the invention as viewed by a person when the apparatus as shown in the drawings is placed with its bottom on a countertop and such that when the handle extends above the top of the apparatus when in the loading position, and such that the handle extends in front of the apparatus when in the sealing position. However, it is to be understood that the invention may assume various alternative orientations, except where expressly specified to the contrary. It is also to be understood that the specific device illustrated in the attached drawings and described in the following specification is simply an exemplary embodiment of the inventive concepts defined in the appended claims. Hence, specific dimensions, proportions, and other physical characteristics relating to the embodiment disclosed herein are not to be considered as limiting, unless the claims expressly state otherwise.

Having generally described various aspects and features of the present invention, an example of the apparatus is described in detail below. It will be appreciated by those skilled in the art that the following description is only but one example of the apparatus and that the various aspects and features of the present invention may be embodied in other forms of devices. Reference will now be made in detail to the present preferred embodiment of the invention, an example of which is illustrated in the accompanying drawings. Wherever possible, the same reference numerals will be used throughout the drawings to refer to the same or like parts.

As shown in FIGS. 1A through 5 and 7 through 13B, an example of an apparatus 10 of the present invention includes a base 20, a container holder 50 for holding a food container 200 (FIG. 6), a heater platen 70 positioned within the base 20, and a pressure applicator 76 positioned on an upper surface 72 of the heater platen 70. The container holder 50 is slidably mounted with respect to the base 20 between a loading position and a sealing position. When the container holder 50 is in the loading position, a food container 200 may be loaded onto the container holder 50 and a sealing film may be pulled over the food container. To move the container holder 50 into the sealing position, it is slid into the base 20 beneath the heater platen 70.

A handle 60 may be provided to move heater platen 70 downwards onto the sealing film and food container while the container holder 50 is in the sealing position to thereby apply heat and pressure creating a tightly sealed food container. The handle 60 may then be operated to lift the heater platen 70 such that the container holder 50 may then be slid back to the loading position where the sealed food container may be removed.

Figure 1B:
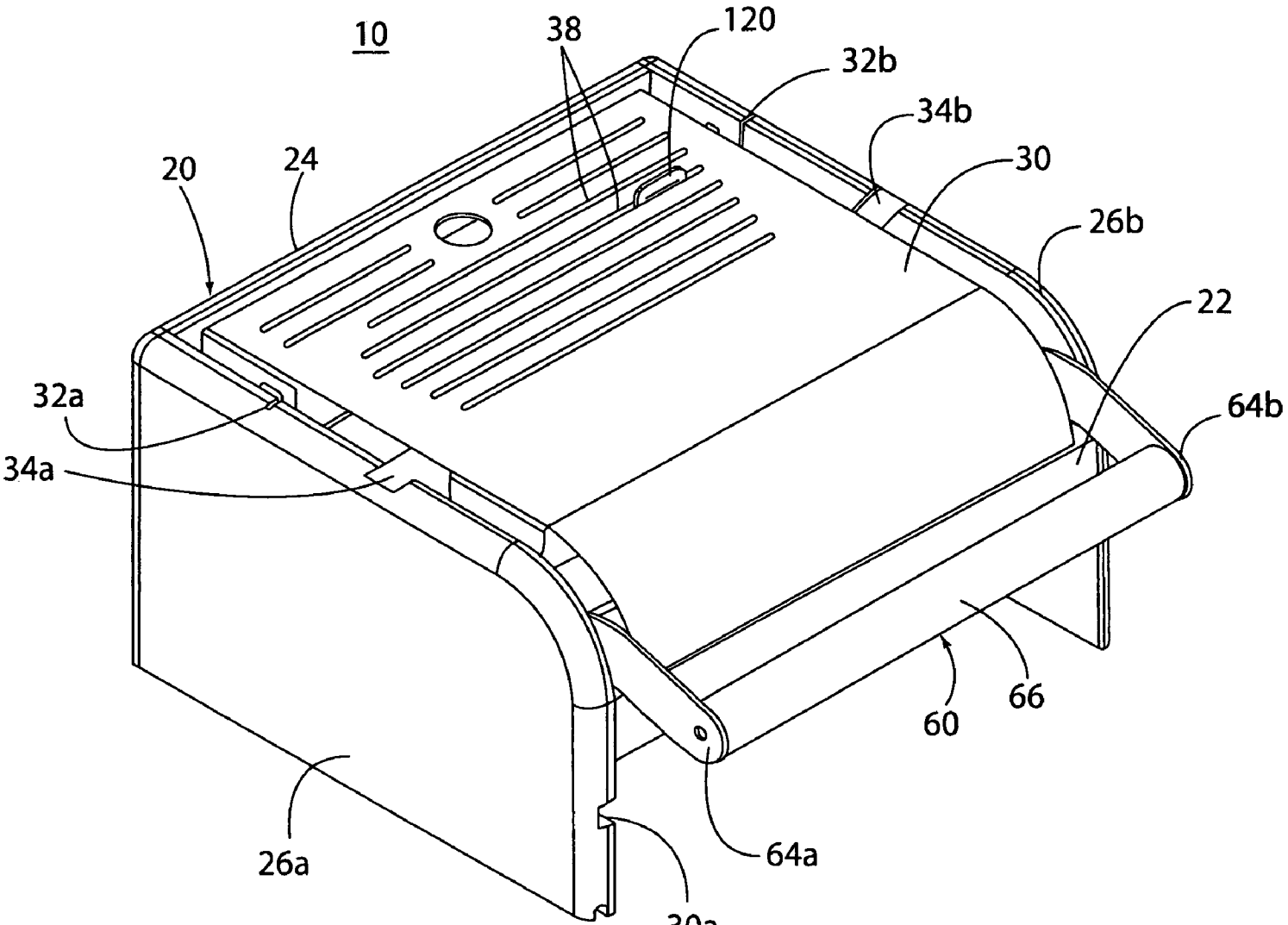
FIG. 1B is a perspective view of a first embodiment of the apparatus of the present invention with the handle in the sealing position.
Figure 2A:
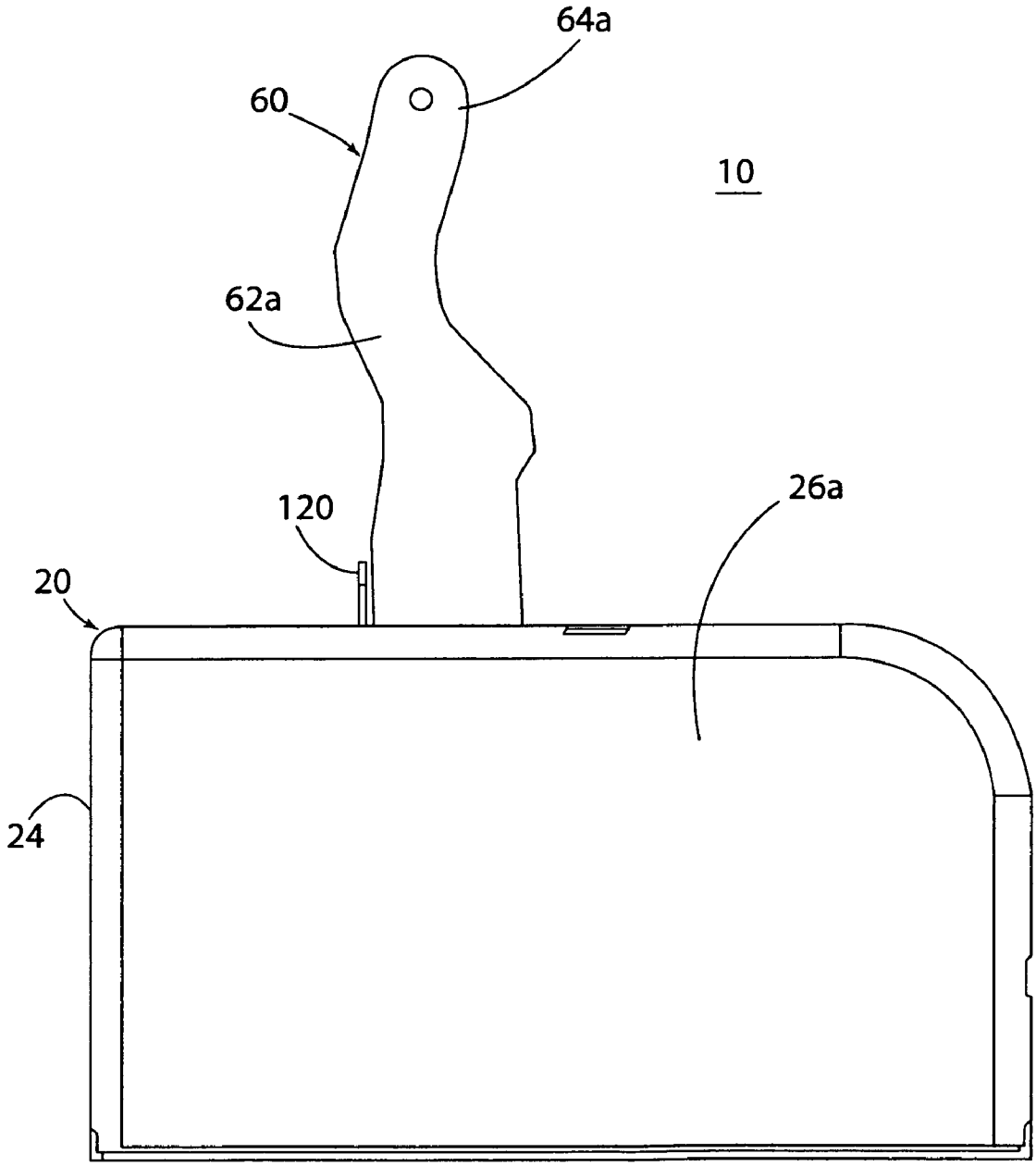
FIG. 2A is a side elevational view of the apparatus according to the first embodiment shown with the handle in the loading position.
Figure 2B:
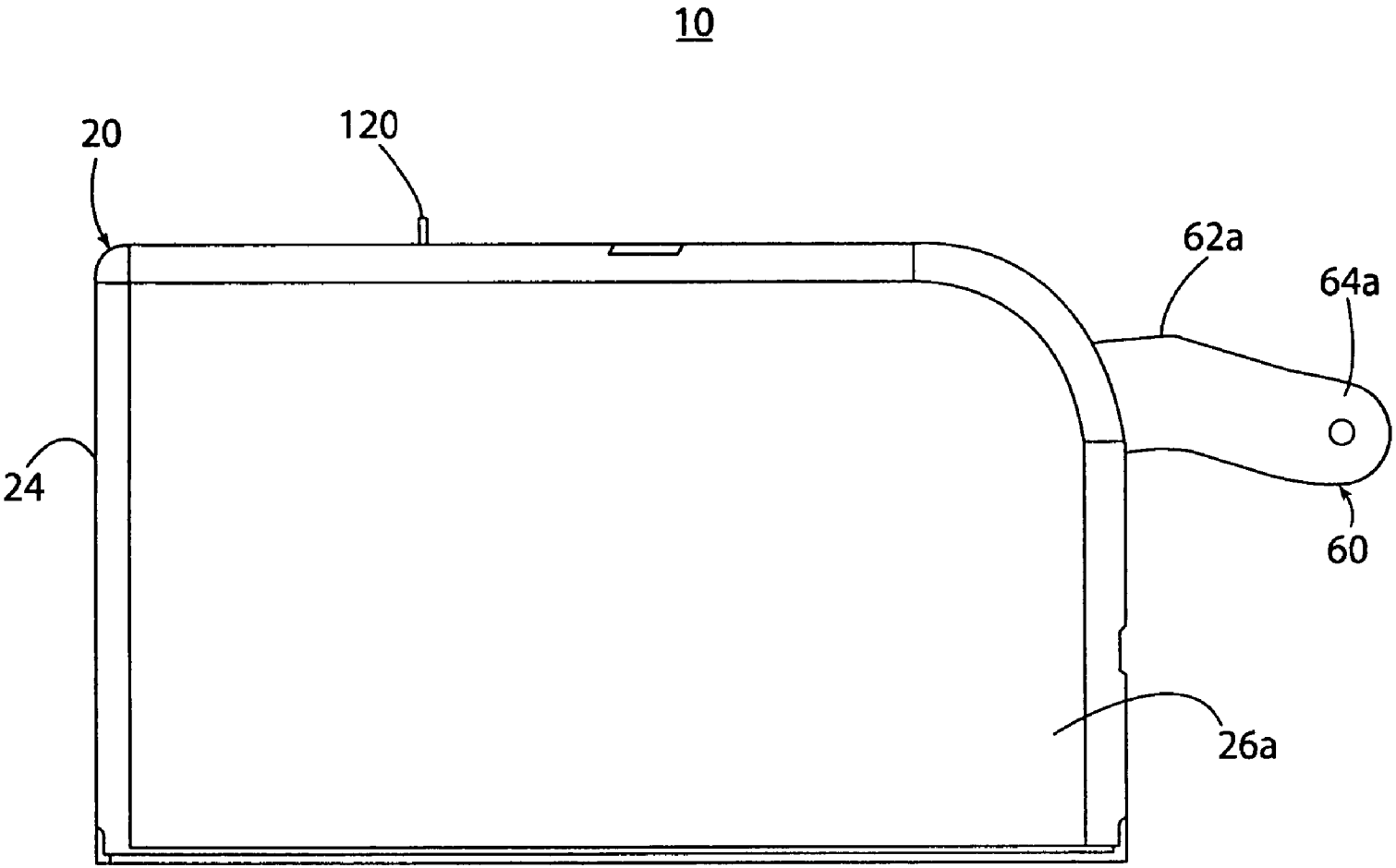
FIG. 2B is a side elevational view of the apparatus according to the first embodiment shown with the handle in the sealing position.
Figure 3A:
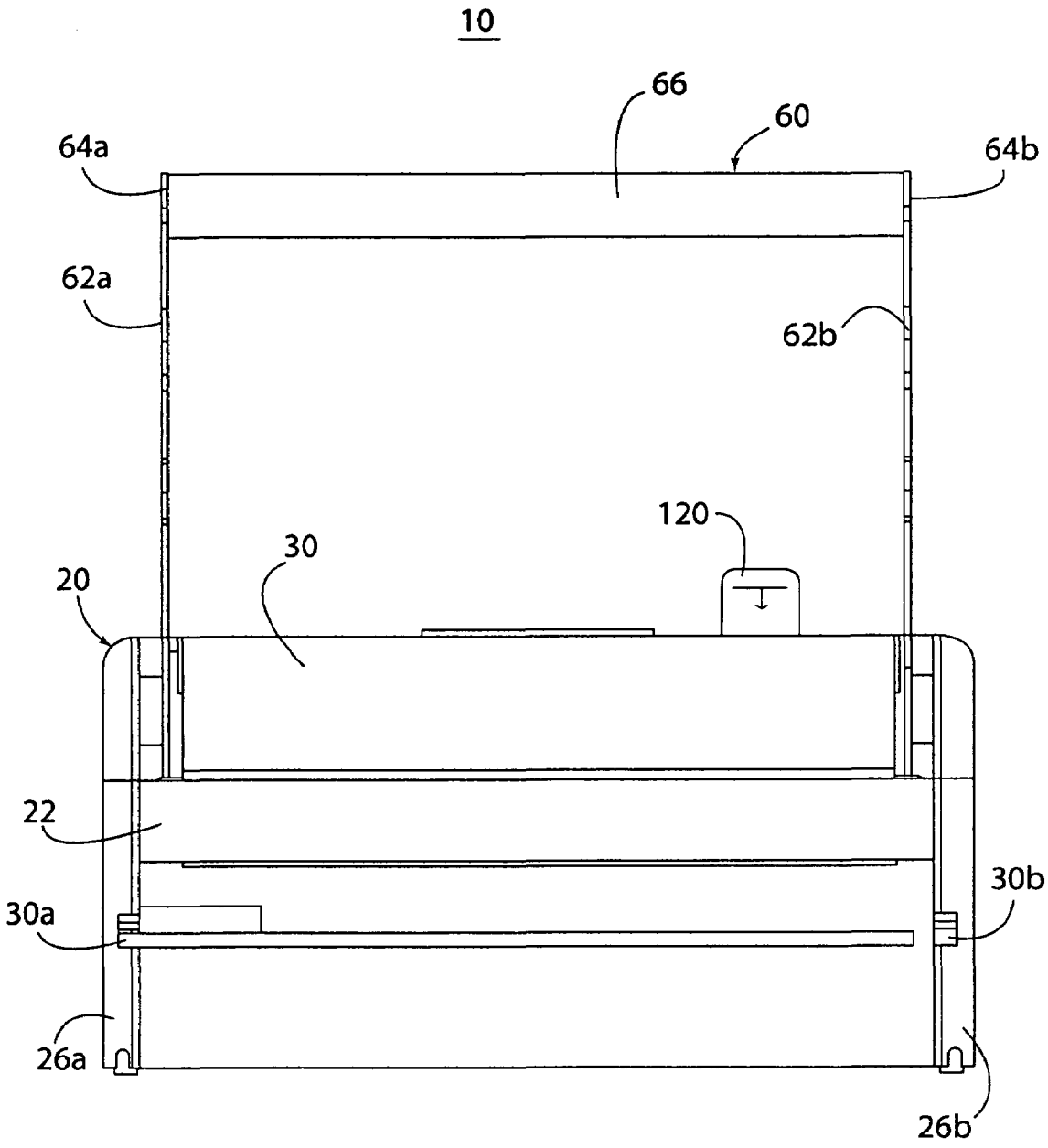
FIG. 3A is a front elevational view of the apparatus of the first embodiment shown with the handle in the loading position.
Figure 3B:
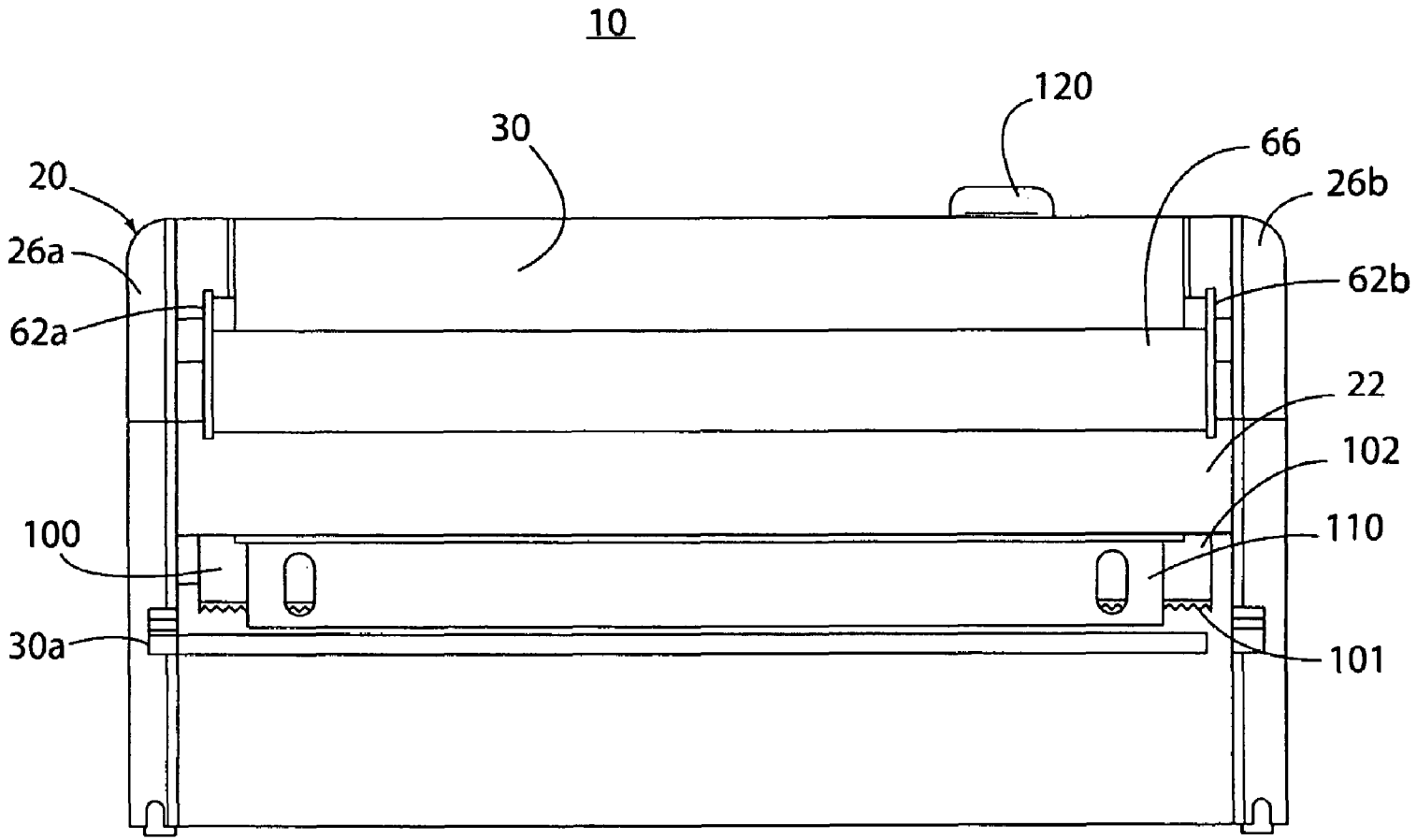
FIG. 3B is a front elevational view of the apparatus of the first embodiment shown with the handle in the sealing position.
Figure 4:
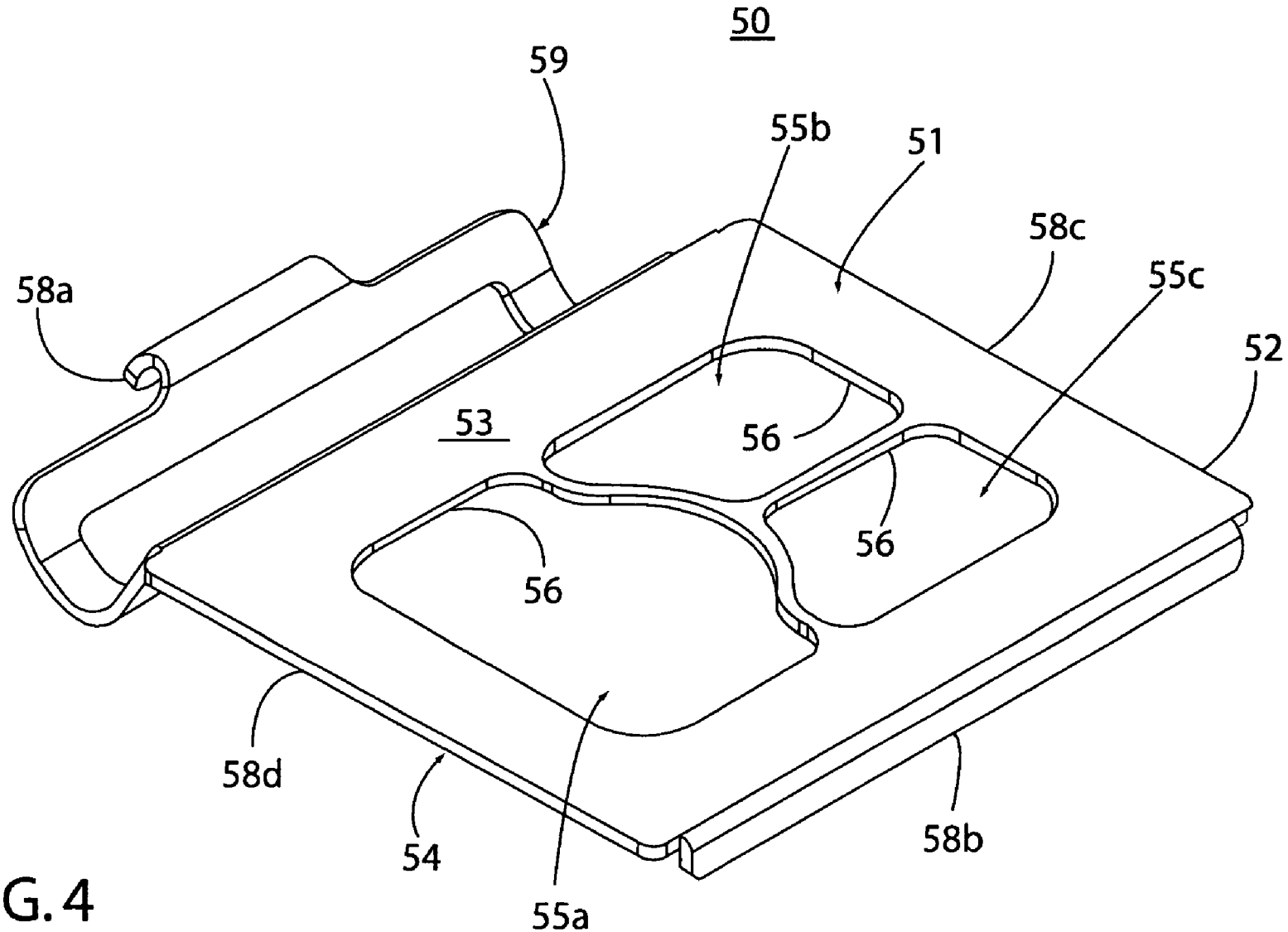
FIG. 4 is a perspective view of a container holder used with the apparatus shown in FIGS. 1A-3B.
Figure 5:
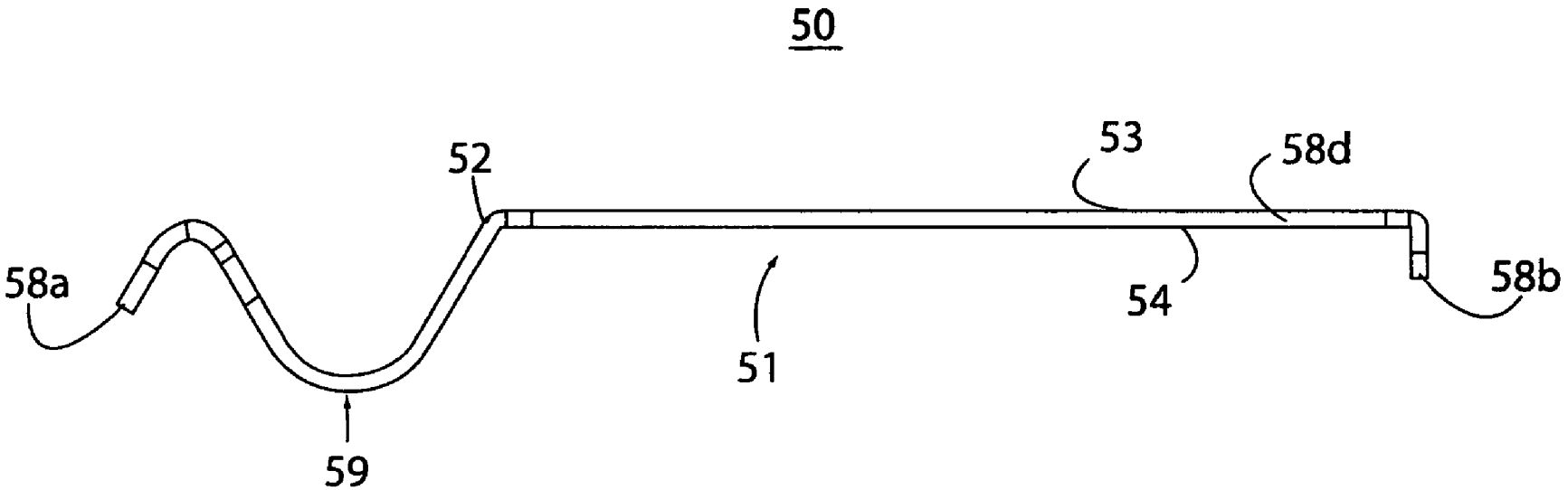
FIG. 5 is a side elevational view of the container holder shown in FIG. 4.

As best shown in FIGS. 1A and 1B, the base 20 comprises a front panel 22, a rear panel 24, and two opposing substantially vertical side panels 26*a* and 26*b* extending between the front panel 22 and the rear panel 24. The base panels may be made of any suitable material, such as an ultra-high molecular weight polymer. A lid 30 extends from the rear panel 24 to the front panel 22 to cooperate with the base 20 to form a housing for the apparatus. The lid 30 may be made of any suitable material including sheet metal. As best shown in FIGS. 9A, 9B, 12A and 12B, the lid 30 includes side tabs 31*a* and 31*b* with slots 33*a* and 33*b* for engaging corresponding screws 35 (FIGS. 12A and 12B) extending from inner surfaces of the side panels 26*a* and 26*b*. A front end 37 of the lid 30 snaps around the inner surface of front panel 22 of the base 20.

The illustrated container holder 50 (FIGS. 4 and 5) may be made in any manner, but preferably is formed of laser-cut sheet metal (preferably stainless steel). The metal sheet 52 of the container holder 50 has a top surface 53, a bottom surface 54, a front edge 58*a*, a rear edge 58*b*, and side edges 58*c* and 58*d*. The metal sheet 52 includes a planar first portion 51 on which the food container is supported and moved within the base 20 beneath the heater platen 70. The front edge 58*a* of the metal sheet 52 extends outward from the base 20 even when the container holder 50 is in the sealing position.

In the illustrated example, the container holder 50 may be configured to hold a roll of the sealing film such that a portion of the sealing film may be unrolled and pulled over the food container when the container holder 50 is in the loading position. The metal sheet 52 may thus have a second portion 59 located between a planar first portion 51 and the front edge 58*a*, which is shaped to support the roll of sealing film. Accordingly, a second portion 59 extends below a plane of the planar first portion 51 and is shaped as a partial cylinder to support the roll of sealing film on the top surface 53 of the metal sheet 52.

At least one opening (55*a*, 55*b*, 55*c*) through the planar first portion 51 of the metal sheet 52, which is circumscribed by an inner edge 56, extends between the top surface 53 and the bottom surface 54. The container holder 50 may further comprise a resilient gasket 95*a* and 95*b* (FIGS. 7 and 8) having a thickness greater than that of the metal sheet 52 and having a groove (96*a*, 96*b*) formed therein for receiving the inner edge 56 so as to contact both the top surface 53 and the bottom surface 54 of the metal sheet 52 and to line the opening(s) (55*a*, 55*b*, 55*c*) to provide an upper support surface (98*a*, 98*b*) above the top surface 53 of the metal sheet 52 upon which portions of a food container 200 are supported. The supported portions of the food container correspond to locations where the sealing film is to be sealed to the food container.

Figure 6:
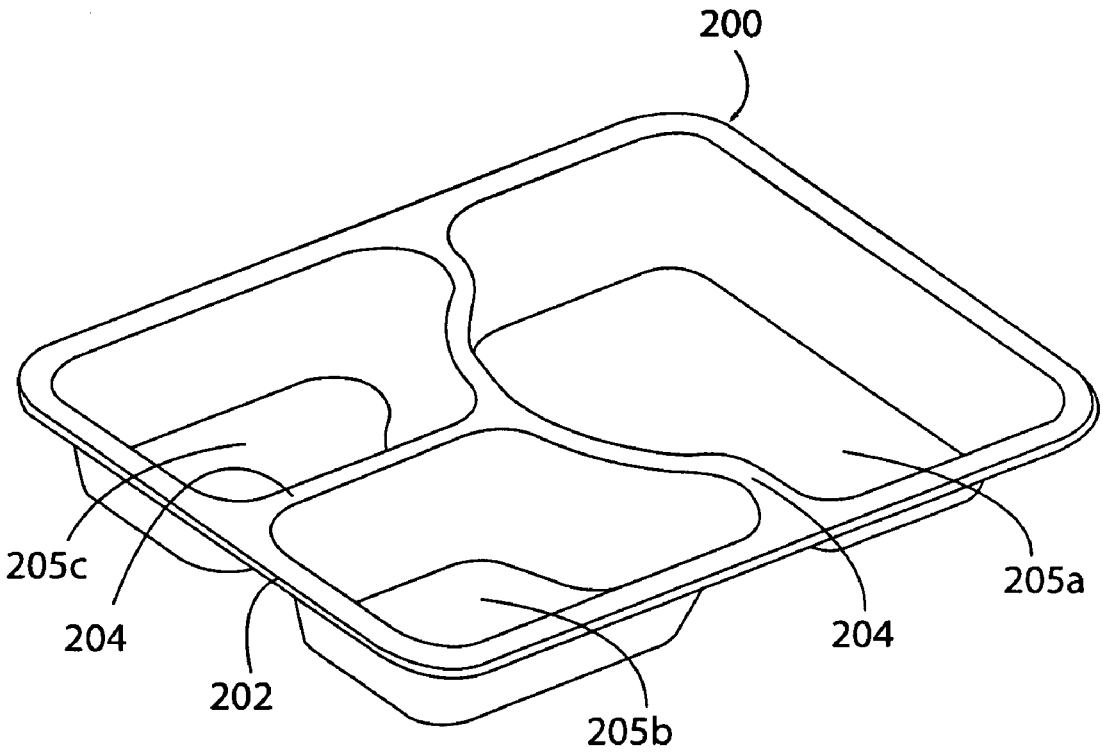
FIG. 6 is a perspective view of a food tray of the type that may be used with the apparatus of the present invention.
Figure 7:
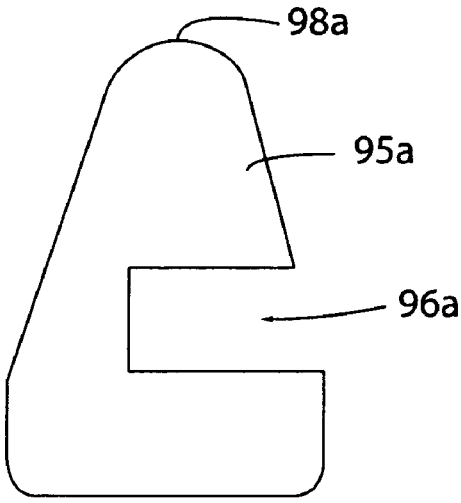
FIG. 7 is a cross-sectional view of an outer gasket used on the container holder shown in FIGS. 4 and 5.
Figure 8:
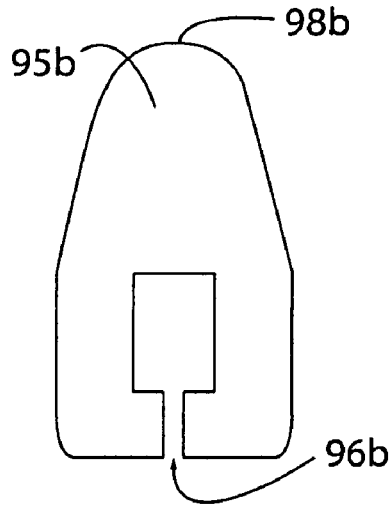
FIG. 8 is a cross-sectional view of an inner gasket that may be used with the container holder shown in FIGS. 4 and 5.
Figure 9B:
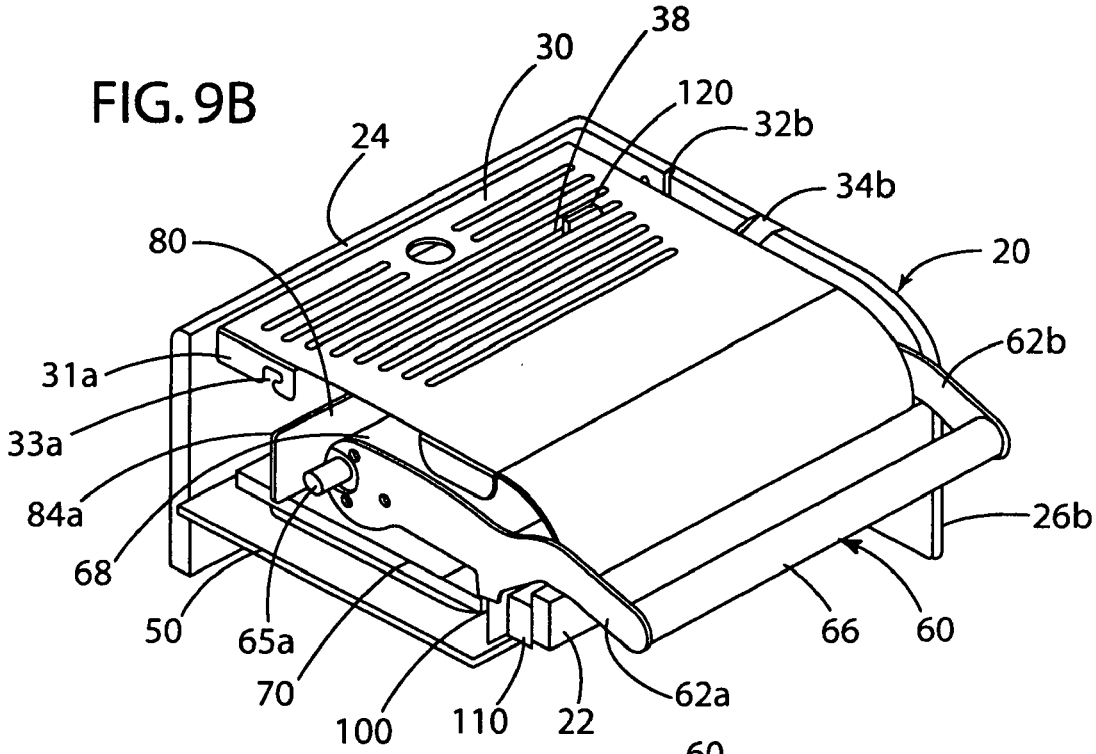
FIG. 9B is a front perspective view of the apparatus of the first embodiment with the handle in the sealing position and a side panel of the base removed.
Figure 9A:
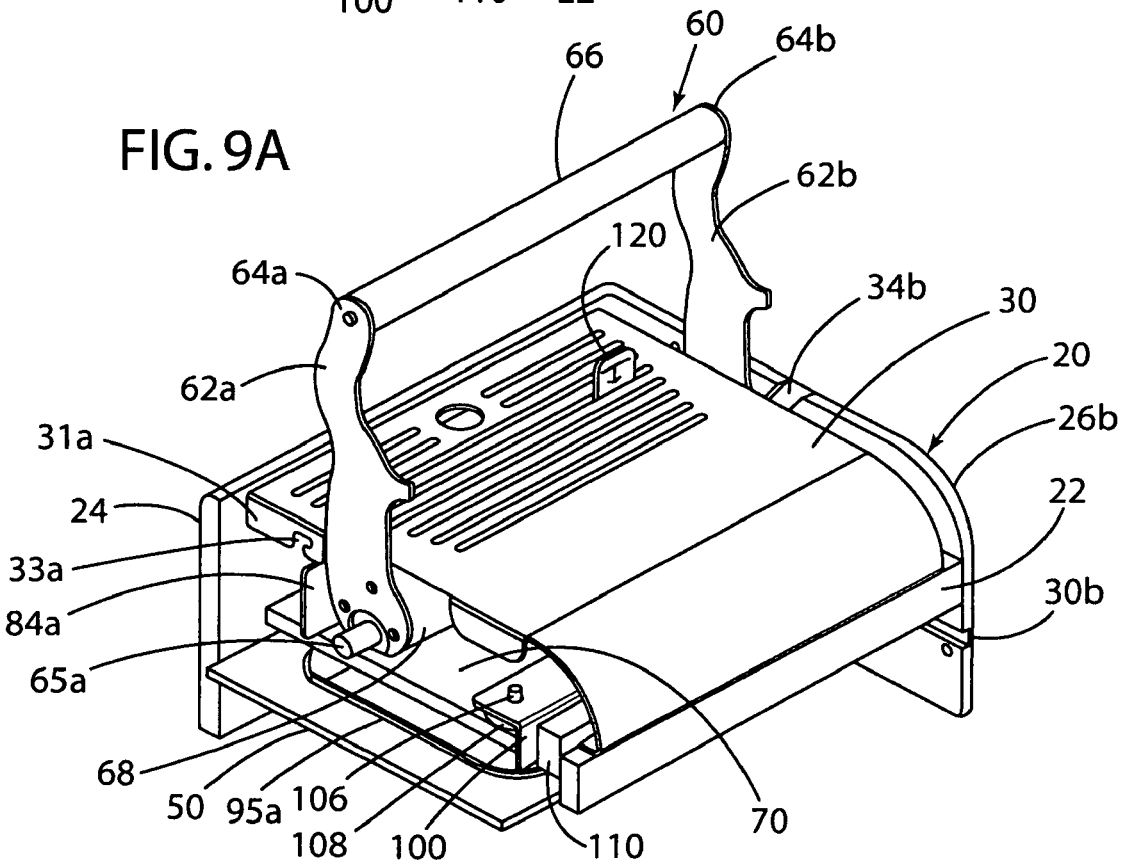
FIG. 9A is a front perspective view of the apparatus of the first embodiment with the handle in the loading position and a side panel of the base removed.
Figure 10B:
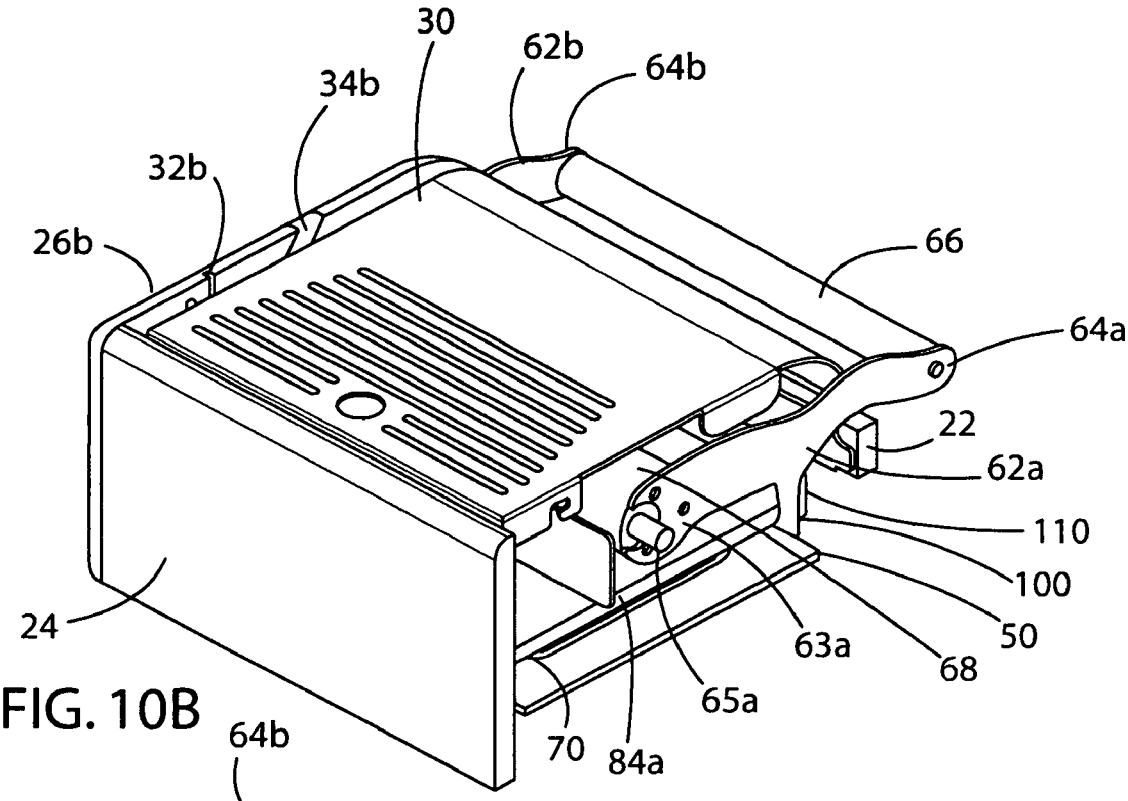
FIG. 10B is a rear perspective view of the apparatus of the first embodiment with the handle in the sealing position and a side panel of the base removed.
Figure 10A:
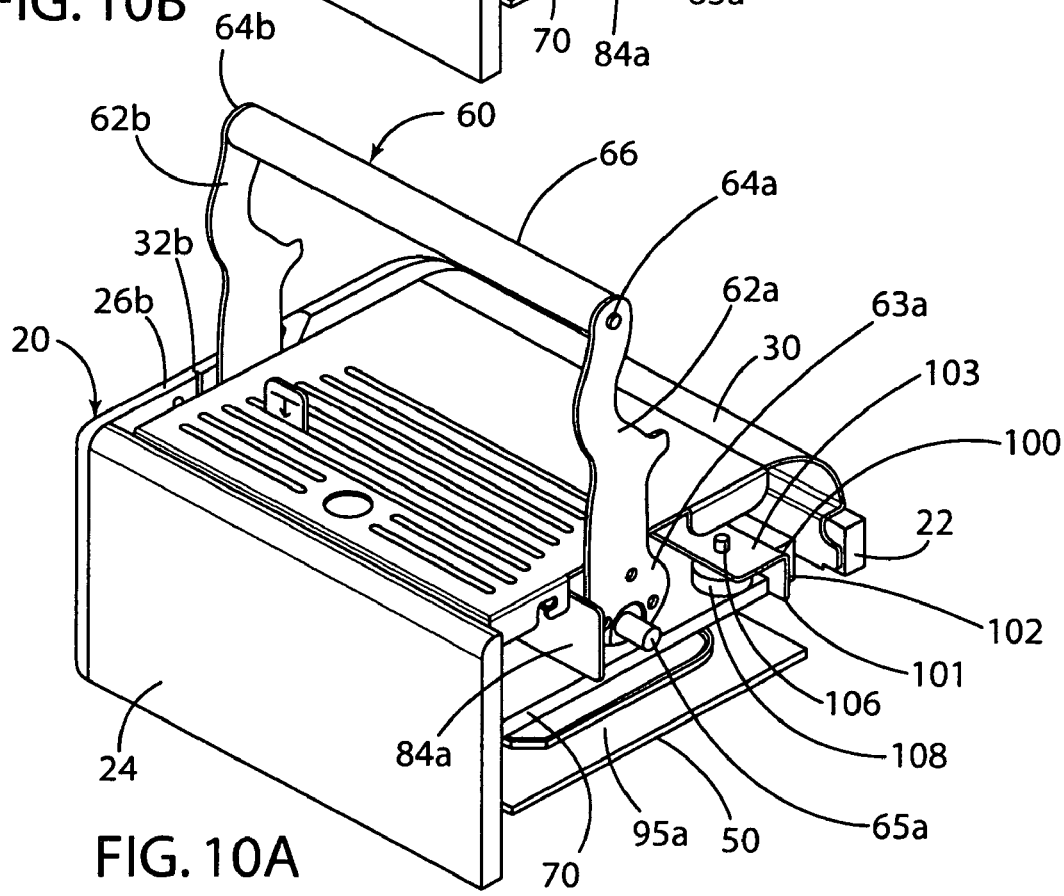
FIG. 10A is a rear perspective view of the apparatus of the first embodiment with the handle in the loading position and a side panel of the base removed.
Figure 11A:
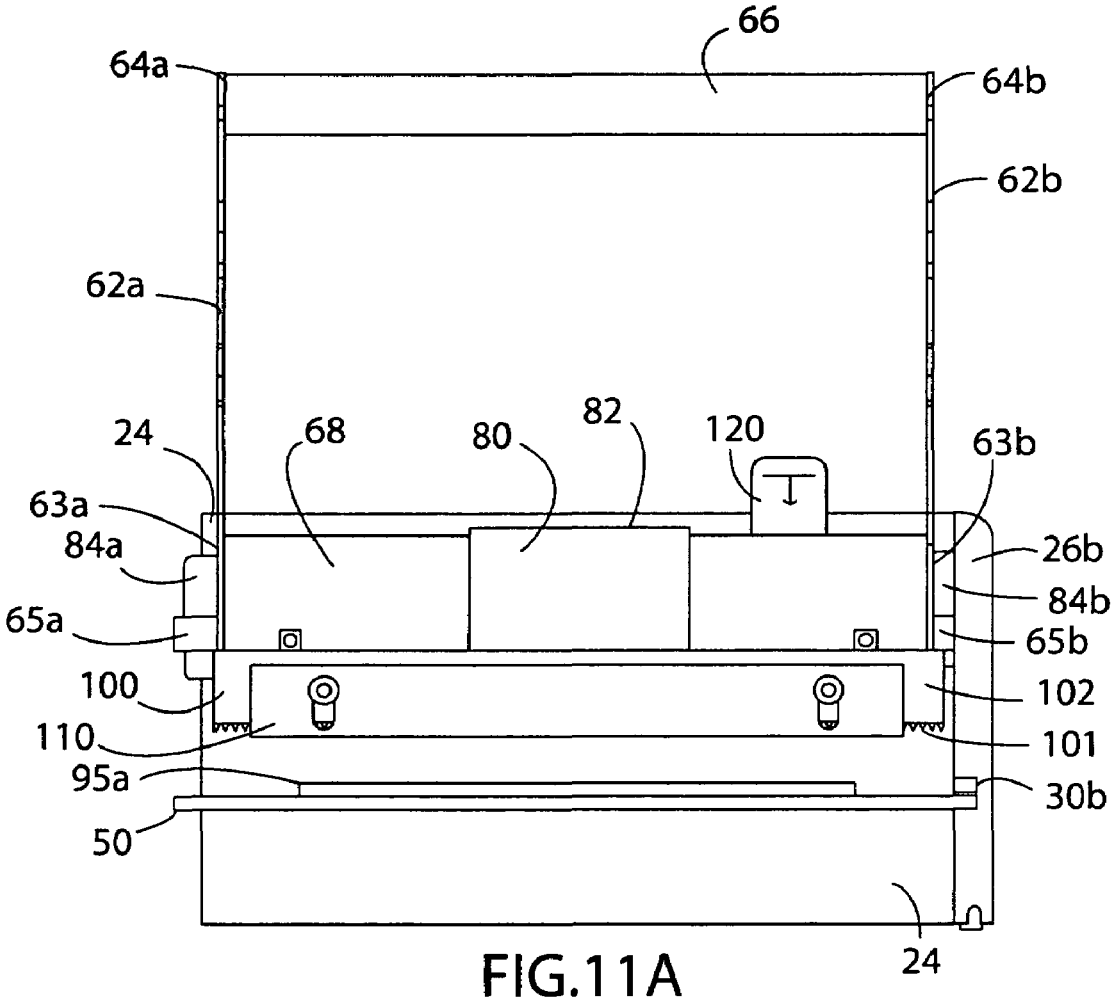
FIG. 11A is a front elevational view of the apparatus of the first embodiment shown with the handle in the loading position and with a side panel and the front panel of the base removed and with the lid removed.
Figure 11B:
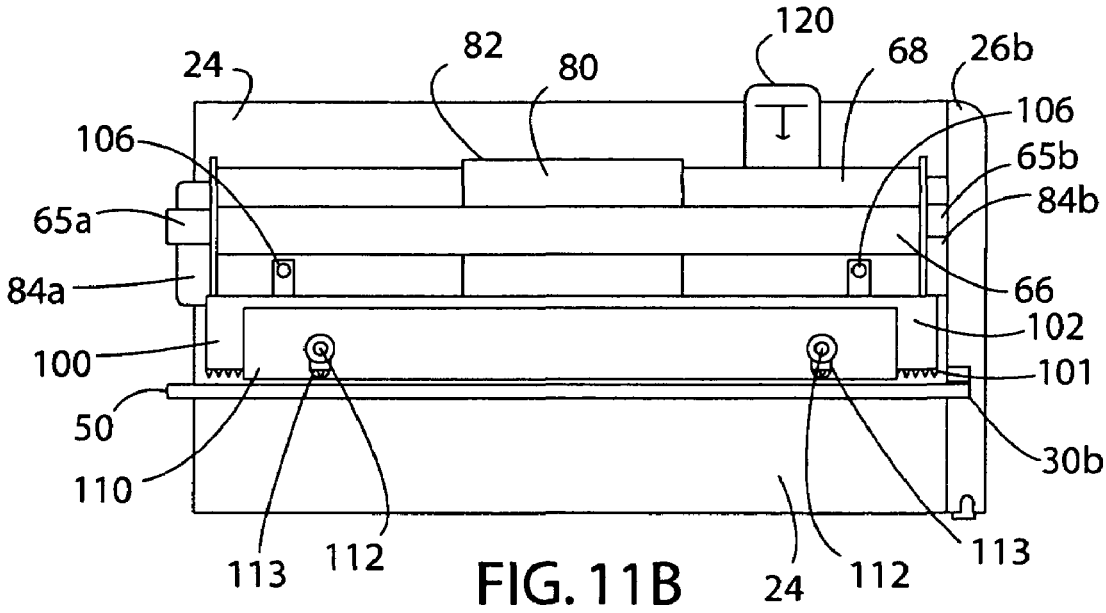
FIG. 11B is a front elevational view of the apparatus of the first embodiment shown with the handle in the sealing position and with a side panel and the front panel of the base removed and with the lid removed.
Figure 12B:
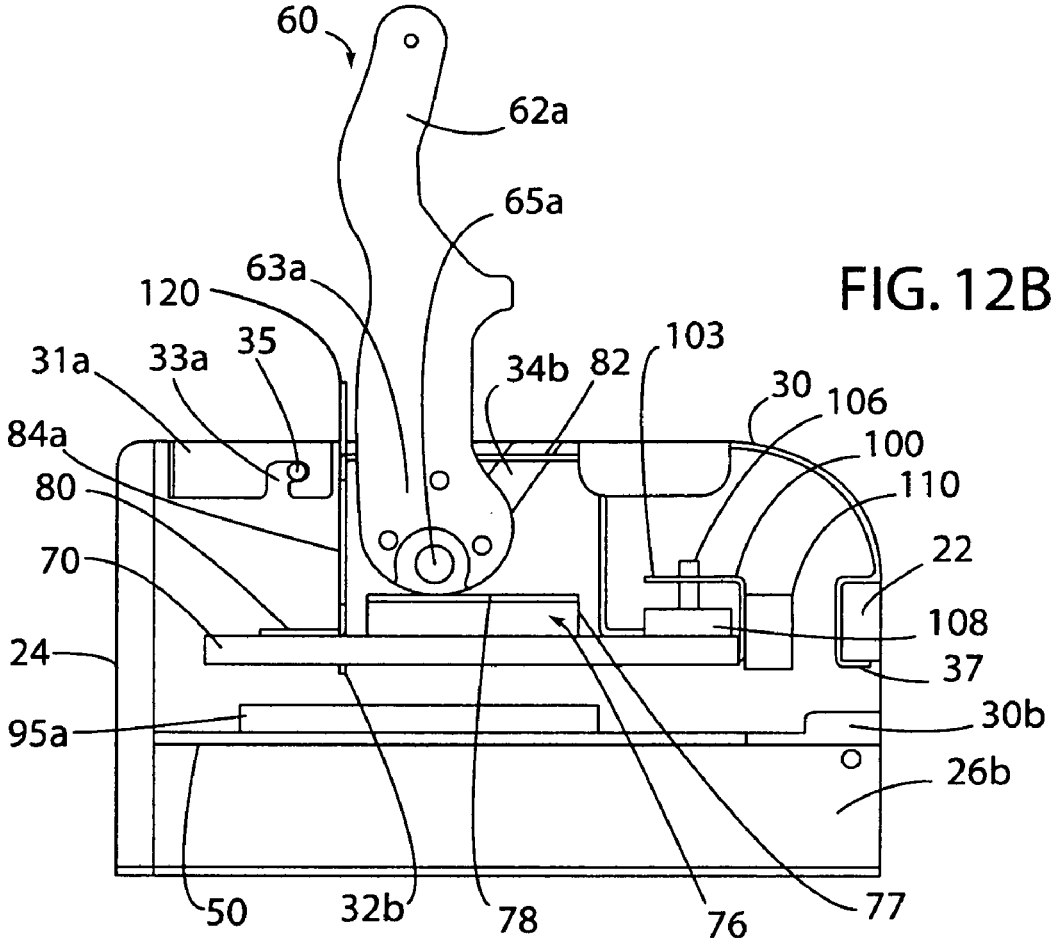
FIG. 12B is a side elevational view of the apparatus of the first embodiment shown with the handle in the sealing position and with a side panel of the base removed.
Figure 12A:
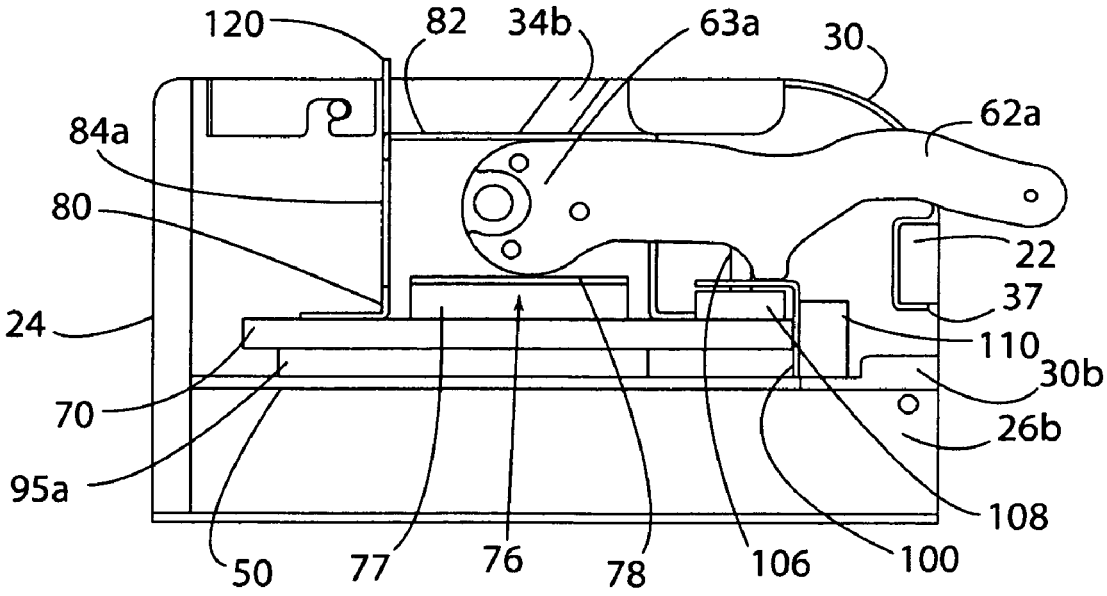
FIG. 12A is a side elevational view of the apparatus of the first embodiment shown with the handle in the loading position and with a side panel of the base removed.
Figure 13A:
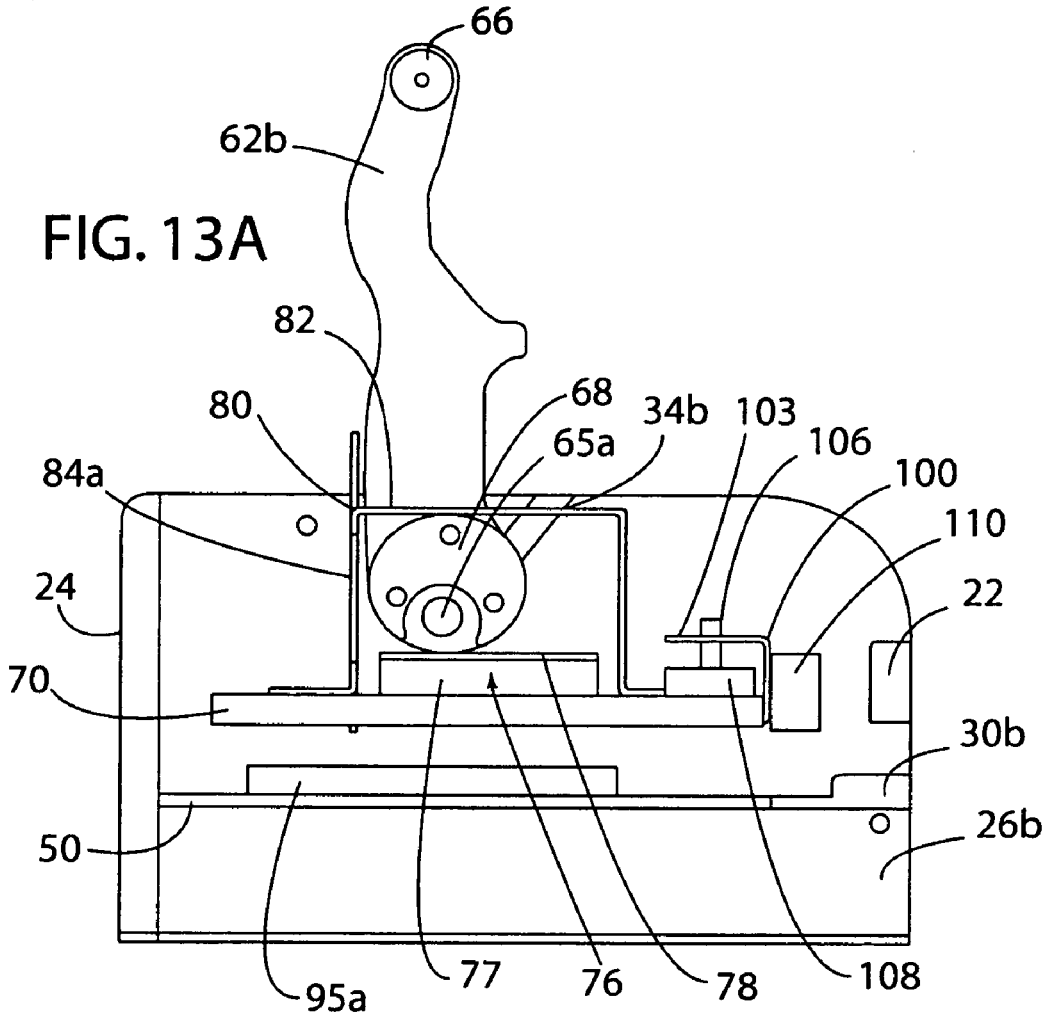
FIG. 13A is a side elevational view of the apparatus of the first embodiment shown with the handle in the loading position and with the following components removed: a side panel of the base; the lid; and a side arm of the handle.
Figure 13B:
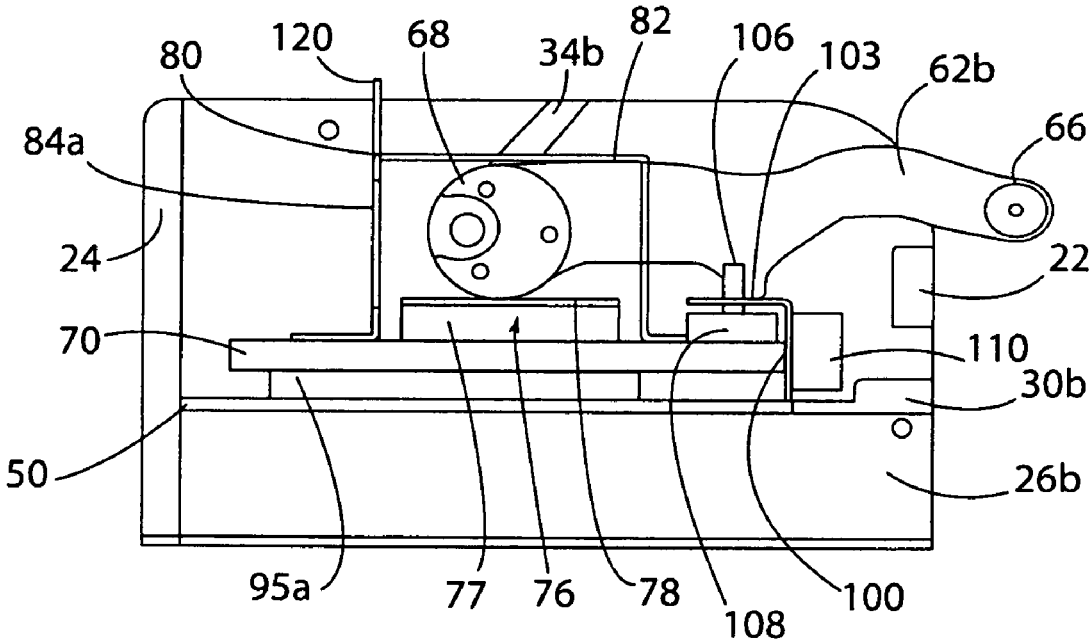
FIG. 13B is a side elevational view of the apparatus of the first embodiment shown with the handle in the sealing position and with the following components removed: a side panel of the base; the lid; and a side arm of the handle.

A first gasket 95*a* is shown in FIG. 7. The first gasket 95*a* includes a groove 96*a* formed in a side thereof for receiving the inner edge 56 along the outer perimeter of the opening(s) in the container holder 50 that correspond to the outer perimeter 202 of a food container 200 (FIG. 6). A second gasket 95*b* is shown in FIG. 8. The second gasket 95*b* includes a groove 96*b* formed in its bottom surface for receiving the inner edges 56 and a portion of the top surface 53 along an inner portion of the opening(s) in the container holder 50 that correspond to the inner partitions 204 of a multi-compartment food tray. It will be appreciated that if the food container only has a single compartment, the second gaskets 95*b* would not be used. In general, if the food container 200 is a food tray having a plurality of sealable compartments (205*a*, 205*b*, 205*c*), a gasket-lined opening (55*a*, 55*b*, 55*c*) is provided for each one of the sealable compartments and has a corresponding shape and size. It should be noted that the multi-compartment food tray 200 shown in FIG. 6 is just one example, and that the food containers may have various shapes and sizes and may be configured for holding liquids such as soup or beverages.

The illustrated gaskets 95*a* and 95*b* may be formed of any suitable material and are preferably formed of a resilient rubber, such as a silicone rubber. The gaskets 95*a* and 95*b* are preferably formed by extrusion so as to have a very low cost.

As mentioned above, the apparatus 10 may further include the handle 60 attached to the base 20 to move between a loading position (FIGS. 1A, 2A, 3A, 9A, 10A, 11A, 12A, and 13A) and a sealing position (FIGS. 1B, 2B, 3B, 9B, 10B, 11B, 12B, and 13B). The handle 60 comprises a pair of side arms 62*a* and 62*b* each having a base end 63*a* and 63*b* and a distal end 64*a* and 64*b*. The handle 60 further comprises a handle member 66 extending between the distal ends 64*a* and 64*b* of the side arms 62*a* and 62*b*. The base ends 63*a* and 63*b* of the side arms 62*a* and 62*b* are held to the base 20 by a pair of pins 65*a* and 65*b* aligned on a common axis such that the handle 60 may be rotated about the common axis. The handle 60 may further have a cam 68 positioned between the base ends 63*a* and 63*b* of the side arms 62*a* and 62*b*. The cam 68 may be made of any suitable material, but is preferably made of an ultra-high molecular weight polymer. The cam 68 may have an eccentric shape or be a cylinder having a central axis. If the cam 68 is cylindrical, it may be mounted between the base ends 63*a* and 63*b* of the side arms 62*a* and 62*b* such that the central axis of the cylindrical cam 68 is parallel to, but not, coaxial with, the common axis defined by pins 65*a* and 65*b* whereby the cylindrical cam 68 is rotated about the common axis as the handle 60 is rotated. The pressure applicator 76 may then be positioned between a portion of the cam 68 and the upper surface 72 of the heater platen 70 whereby, as the handle 60 is rotated from the loading position to the sealing position, the cam 68 rotates and thereby presses downward against the pressure applicator 76, which, in turn, applies pressure to the heater platen 70 causing heater platen 70 to be pressed downward into the sealing position.

As shown in FIGS. 11A-13B, the apparatus 10 may further comprise a bracket 80 mounted to the heater platen 70. The bracket 80 may include a horizontal member 82 that extends over the cam 68. As best shown in FIGS. 12A and 13A, as the handle 60 is rotated back to the loading position, the cam 68 engages the bottom surface of the horizontal member 82 of the bracket 80 to thereby lift the heater platen 70 from the sealed food container.

The apparatus may further include a pair of guides 84*a* and 84*b* extending vertically from opposite sides of the heater platen 70. As shown in FIGS. 9A-13B, the guides 84*a* and 84*b* are provided on vertical side edges of the bracket 80. The guides 84*a* and 84*b* serve to guide the heater platen 70 vertically within the base 20 as described further below.

The illustrated side panels 26*a* and 26*b* of the base 20 may each have elongated opposing first grooves 30*a* and 30*b* on inner surfaces thereof. The first grooves 30*a* and 30*b* extend substantially horizontally and open to a front of the base 20 to receive the side edges 58*c* and 58*d* of the container holder 50 such that the container holder 50 is horizontally slidable within the base 20. The first grooves 30*a* and 30*b* also support the container holder 50 within the base 20 as the heater platen 70 is pressed downward against the food container and film.

In the illustrated example, the side panels 26*a* and 26*b* of base 20 each may also have elongated opposing second grooves 32*a* and 32*b* on inner surfaces thereof. The second grooves 32*a* and 32*b* extend substantially vertically to receive guides 84*a* and 84*b* such that the guides 84*a* and 84*b*, the bracket 80, and the heater platen 70 are vertically movable within the base 20 above the container holder 50 when in the sealing position. As described further below, the second grooves 32*a* and 32*b* open to the top of the base 20 such that, during manufacture, the bracket 80 may easily be slid into the base 20 from the top (with the lid 30 removed).

The illustrated side panels 26*a* and 26*b* of the base 20 each may also have elongated opposing third grooves 34*a* and 34*b* on inner surfaces thereof. The third grooves 34*a* and 34*b* extend substantially diagonally to receive pins 65*a* and 65*b*, which are fixedly secured to the base ends 63*a* and 63*b* of the side arms 62*a* and 62*b* of the handle 60 and to the cam 68. As described further below, the third grooves 34*a* and 34*b* open to the top of the base 20 such that, during manufacture, the handle 60 may easily be slid into the base 20 from the top (with the lid 30 removed). The third grooves 34*a* and 34*b* are preferably not parallel to the second grooves 32*a* and 32*b* so that the handle 60 cannot be moved vertically within the base 20 once installed.

In the illustrated example, the apparatus 10 may also include a cutting blade bracket 100 mounted to the heater platen 70 and including a cutting blade 101 for cutting the sealing film when the heater platen 70 engages the sealing film. The cutting blade 101 is shown as being serrated, however, it may be configured to include a point along a cutting edge thereof for initially puncturing the sealing film. Such a point may be positioned along the cutting edge in a location where the point initially punctures the sealing film at an approximate middle point along a width of the sealing film. The cutting blade bracket 100 includes a vertical member 102 having the cutting blade 101 provided on its lowest end proximate the lower surface of the heater platen 70, and a horizontal member 103 extending rearwardly from the uppermost end of a vertical member 102 above the upper surface of the heater platen 70. The horizontal member 103 includes a pair of holes for receiving a corresponding pair of vertical guide posts 106 extending upward from the upper surface of the heater platen 70 in such a manner that the cutting blade bracket 100 may slide vertically along the posts 106. A pair of stops 108 is provided at the lower end of the guide posts 106 to limit downward travel of the cutting blade 101 relative to the lower surface of the heater platen 70. As shown in FIGS. 12A-13B, as the handle 60 is moved downward into the sealing position, a portion of the handle 60 presses against the upper surface of the horizontal member 103 thereby pushing the cutting blade 101 downward against the sealing film, thereby causing the blade 101 to cut the sealing film.

As shown in FIGS. 9A-13B, a pincher bar 110 may be attached to the front surface of the vertical member 102 of the cutting blade bracket 100 to pinch the sealing film against the upper surface of the container holder 50 as the handle 60 is moved to the sealing position such that the sealing film is pinched therebetween before the cutting blade 101 cuts the sealing film. On the other side of the cutting blade 101, the sealing film is pinched between the lower surface of the heater platen 70 and the food container 200. The pincher bar 110 is attached to the cutting blade bracket 100 so as to hang from a front edge thereof in front of the cutting blade 101 such that when the pincher bar 110 presses the sealing film against the container holder 50, the heater platen 70 may be lowered further to engage the sealing film without applying further pressure on the pincher bar 110. The cutting blade bracket 100 has at least two hangers 112 extending from the front edge thereof and the pincher bar 110 includes a corresponding number of vertical slots 113 each for loosely receiving one of the hangers 112 to permit the pincher bar 110 to vertically shift relative to the cutting blade bracket 100.

The illustrated pressure applicator 76 may include a rubber pad 77, and may further include a metal plate 78 placed between the rubber pad 77 and the cam 68. The rubber pad 77 is preferably made of silicone rubber and preferably has a thickness of about ⅜ inch. The pressure applicator 76 is preferably mounted on the heater platen 70 to apply pressure to a central portion of the heater platen 70.

In the illustrated example, the apparatus 10 may further comprise an indicator for indicating that the heater platen 70 is fully in the sealing position. The indicator may be in the form of an indicator flag 120 attached to the heater platen 70 such that markings on the flag 120 disappear from view from the outside of the housing when the heater platen 70 is fully moved into the sealing position. As shown in FIGS. 9A through 13B, the flag 120 is formed as an integral upward extension of the bracket 80 that extends upward through a slot 38 in the lid 30.

The reference numeral 10' (FIGS. 14-23) generally designates another embodiment of the present invention, having a second embodiment for the apparatus. Since apparatus 10' is similar to the previously described apparatus 10, similar parts appearing in FIGS. 1A-13B and FIGS. 14-23, respectively, are represented by the same, corresponding reference number, except for the suffix prime (i.e., "') in the numerals of the latter. As shown in FIGS. 14-23, an example of the second embodiment of the apparatus 10' of the present invention includes a base 20', a container holder 50' for holding a food container 200' (FIG. 6), a heater platen 70' (preferably made of aluminum and having a heater blanket vulcanized to a top thereof, with the heater blanket electrically connected to a power source for heating the heater platen 70') positioned within the base 20', and a pressure applicator 76' positioned on an upper surface 72' of the heater platen 70'. The container holder 50' is slidably mounted with respect to the base 20' between a loading position and a sealing position. When the container holder 50' is in the loading position, the food container 200' may be loaded onto the container holder 50' and a sealing film may be pulled over the food container. To move the container holder 50' into the sealing position, it is slid into the base 20' beneath the heater platen 70'.

A handle 60' may be provided to move heater platen 70' downwards onto the sealing film and food container while the container holder 50' is in the sealing position to thereby apply heat and pressure creating a tightly sealed food container. The handle 60' may then be operated to lift the heater platen 70' such that the container holder 50' may then be slid back to the loading position where the sealed food container may be removed.

Figure 14:
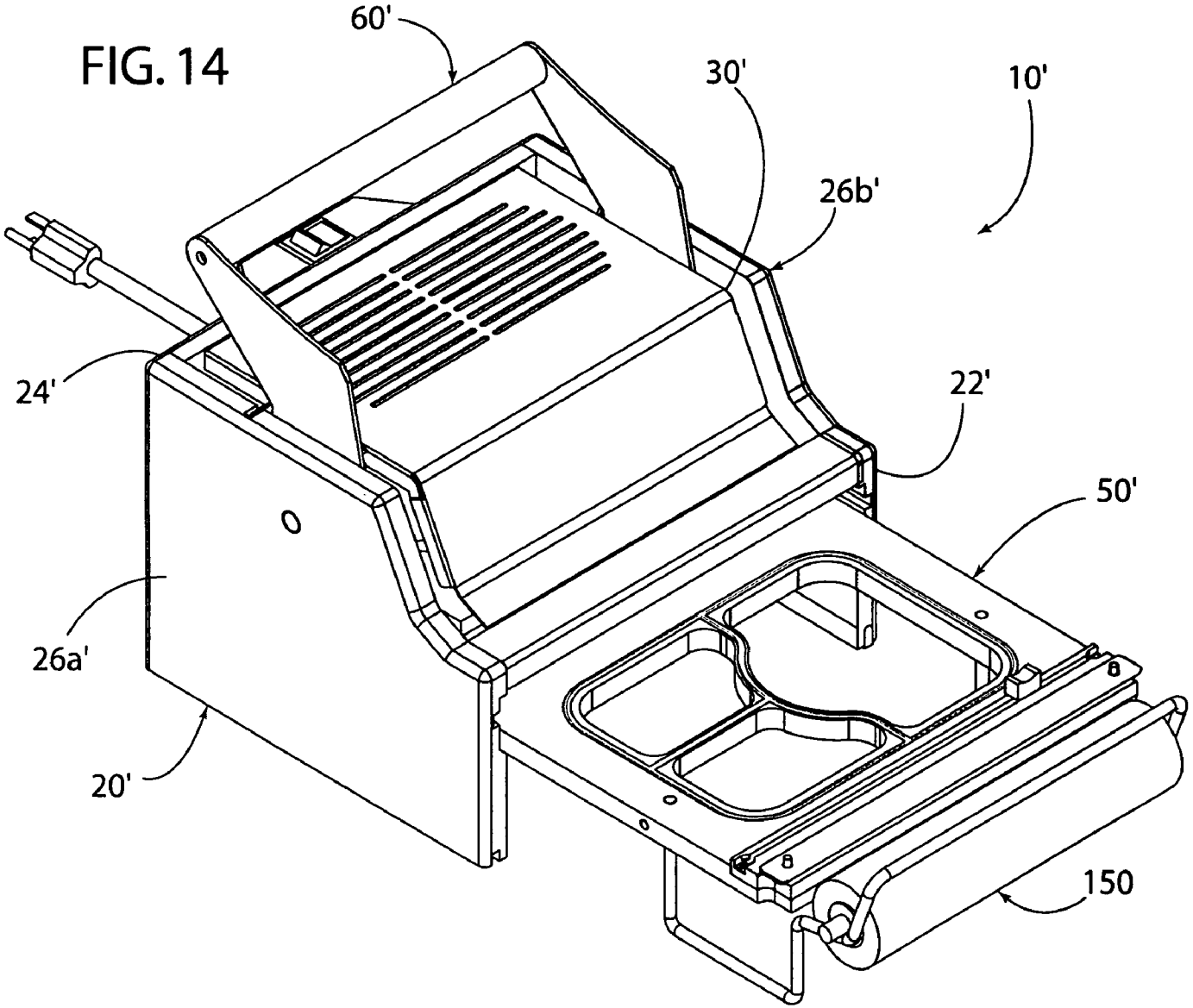
FIG. 14 is a perspective view of a second embodiment of the apparatus of the present invention in a loading position.
Figure 15:
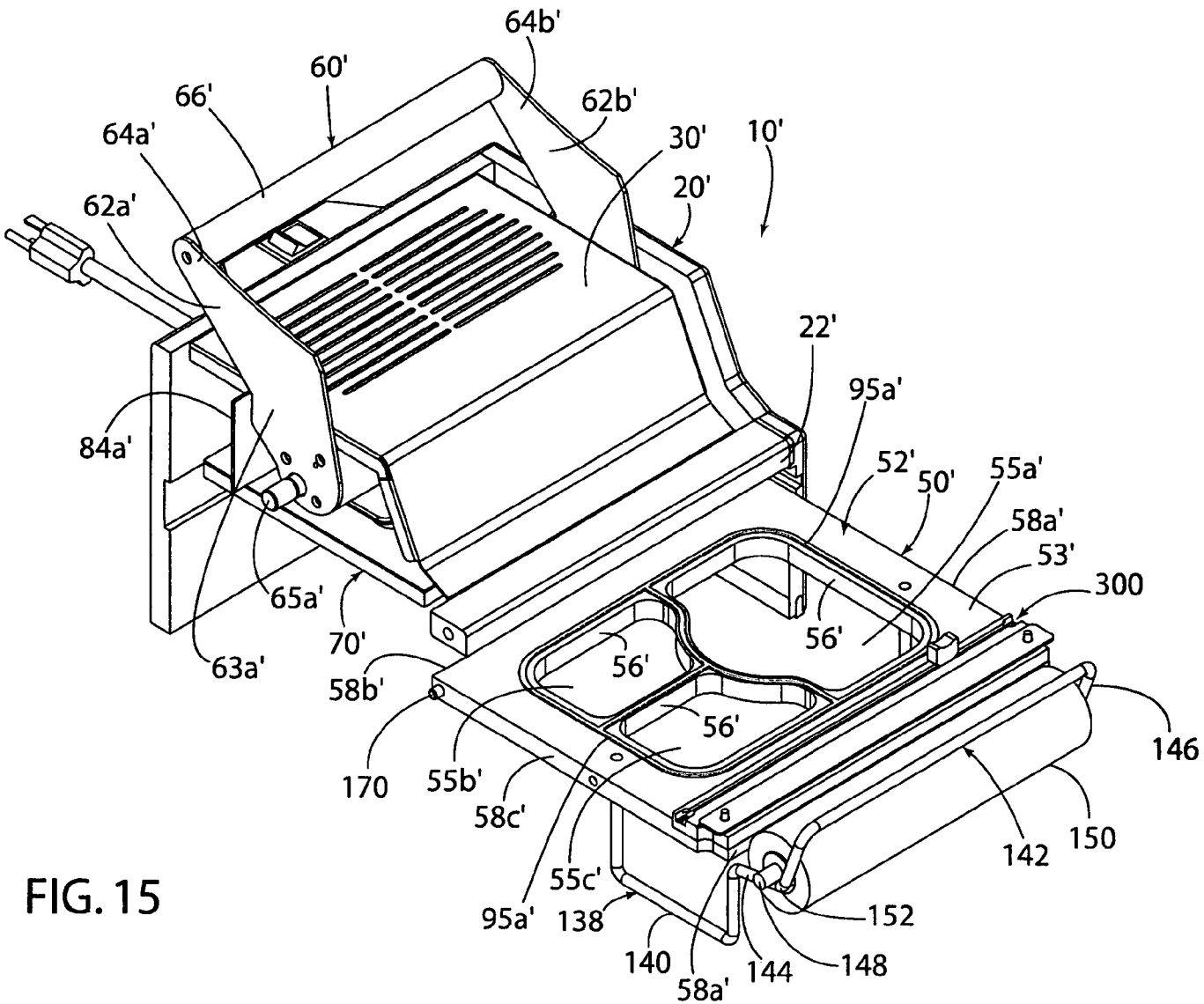
FIG. 15 is a perspective view of the second embodiment of the apparatus in a loading position and with one side wall removed to show details of the apparatus.
Figure 16:
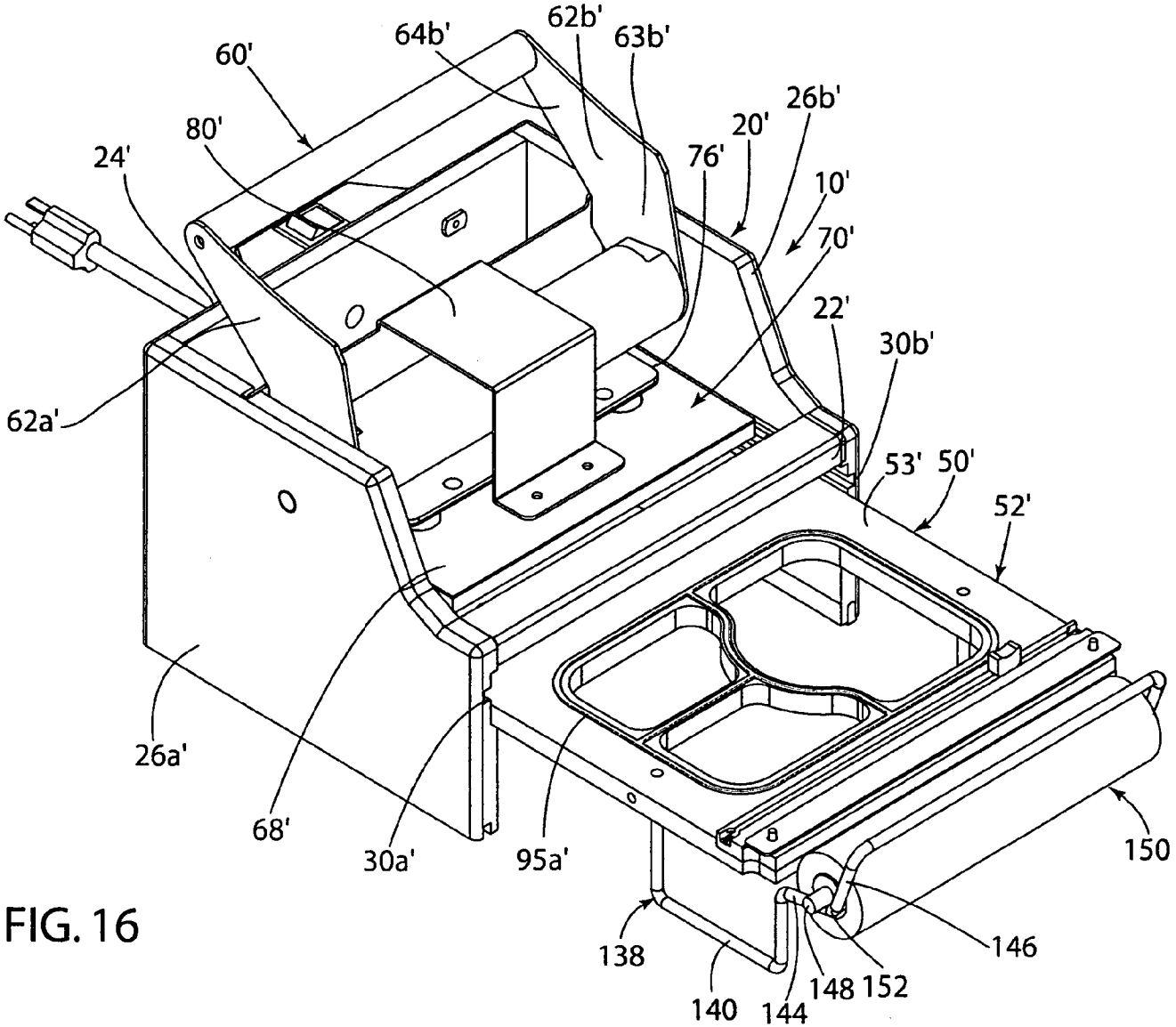
FIG. 16 is a perspective view of the second embodiment of the apparatus in a loading position and with a lid removed to show details of the apparatus.
Figure 17:
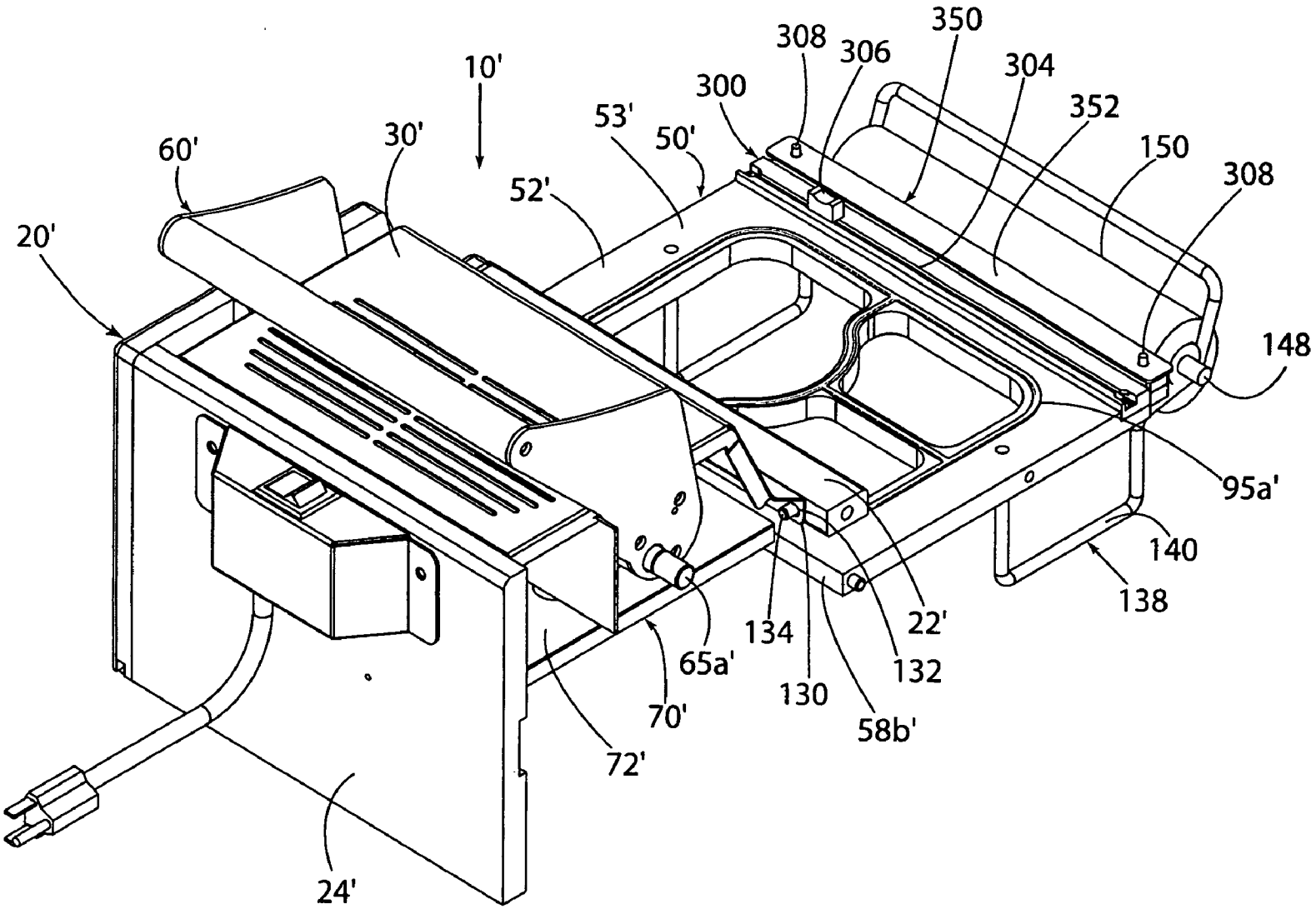
FIG. 17 is a rear perspective view of the second embodiment of the apparatus in a loading position and with one side wall removed to show details of the apparatus.

As best shown in FIGS. 14 and 16, the base 20' comprises a front panel 22', a rear panel 24', and two opposing substantially vertical side panels 26*a*' and 26*b*' extending between the front panel 22' and the rear panel 24'. The base panels may be made of any suitable material, such as an ultra-high molecular weight polymer. A lid 30' extends from the rear panel 24' to the front panel 22' to cooperate with the base 20' to form a housing for the apparatus 10'. The lid 30' may be made of any suitable material including sheet metal. As best shown in FIGS. 17, 18, 20 and 21, the lid 30' includes a front flange 130 having a pair of openings 132 for accepting front prongs 134 extending rearwardly from the front panel 22' and a pair of grooves for accepting rear prongs 136 extending forwardly from the rear panel 24' for connecting the lid 30' to the base 20'.

The illustrated container holder 50' (FIGS. 15-20) may be made in any manner, but preferably is formed of laser-cut metal sheet 52' (preferably stainless steel). The metal sheet 52' of the container holder 50' has a top surface 53', a bottom surface 54', a front edge 58*a*', a rear edge 58*b*', and side edges 58*c*' and 58*d*'. The container holder 50' further includes a pair of feet 138 extending downwardly from the metal sheet 52'. The feet 138 each include a U-shaped portion 140 extending to a surface when the container holder 50' is in the loading position and in the sealing position. The container holder 50' may be configured to hold a roll of the sealing film such that a portion of the sealing film may be unrolled and pulled over the food container when container holder 50' is in the loading position. To hold the sealing film, a roll of sealing film holder section 142 extends forwardly from an end of the U-shaped portion 140. The roll of sealing film holder section 142 includes a first portion 144 and a second portion 146. The first portion 144 is angled slightly upward and the second portion 146 is angled further upward to define an elbow 152. The elbow 152 is configured to support a pair of posts 148 extending from a roll of sealing film 150. When the roll of sealing film 150 is placed on the elbow 152, a rear of the roll of sealing film 150 abuts against the front edge 58*a*' of the metal sheet 52'. Since the first portion 144 is slightly angled, the roll of sealing film 150 will be prevented from rolling because of gravity and the friction against the front edge 58*a*' of the metal sheet 52'.

At least one opening (55*a*', 55*b*', 55*c*') through the metal sheet 52', which is circumscribed by an inner edge 56', extends between the top surface 53' and a bottom surface 54'. The container holder 50' may further comprise a resilient gasket 95*a*' surrounding the openings to provide an upper support surface above the top surface 53' of the metal sheet 52' upon which portions of a food container 200 are supported. The supported portions of the food container correspond to locations where the sealing film is to be sealed to the food container. In general, if the food container 200 is a food tray having a plurality of sealable compartments (205*a*, 205*b*, 205*c*), a gasket-surrounded opening (55*a*', 55*b*', 55*c*') is provided for each one of the sealable compartments and has a corresponding shape and size. It should be noted that the multi-compartment food tray 200 shown in FIG. 6 is just one example, and that the food containers may have various shapes and sizes and may be configured for holding liquids such as soup or beverages. The gaskets 95*a*' may be formed of any suitable material and is preferably formed of a resilient rubber, such as a silicone rubber. The gasket 95*a*' can be adhered or connected to the metal sheet 52' in any manner.

As mentioned above, apparatus 10' may further include the handle 60' attached to the base 20' to move between a loading position (FIGS. 14-19) and a sealing position (FIGS. 20-23). The handle 60' comprises a pair of side arms 62*a*' and 62*b*' each having a base end 63*a*' and 63*b*' and a distal end 64*a*' and 64*b*'. The handle 60' further comprises a handle member 66' extending between distal ends 64*a*' and 64*b*' of the side arms 62*a*' and 62*b*'. The base ends 63*a*' and 63*b*' of side arms 62*a*' and 62*b*' are held to base 20' by a pair of pins 65*a*' and 65*b*' aligned on a common axis such that handle 60' may be rotated about the common axis. The handle 60' may further have a cam 68' positioned between the base ends 63*a*' and 63*b*' of the side arms 62*a*' and 62*b*'. The cam 68' may be made of any suitable material, but is preferably made of an ultra-high molecular weight polymer. The cam 68' may have an eccentric shape or be a cylinder having a central axis. If the cam 68' is cylindrical, it may be mounted between the base ends 63*a*' and 63*b*' of the side arms 62*a*' and 62*b*' such that the central axis of the cylindrical cam 68' is parallel to, but not, coaxial with, the common axis defined by the pins 65*a*' and 65*b*' whereby the cylindrical cam 68' is rotated about the common axis as the handle 60' is rotated. The pressure applicator 76' may then be positioned between a portion of cam 68' and the upper surface 72' of the heater platen 70' whereby, as the handle 60' is rotated from the loading position to the sealing position, the cam 68' rotates and thereby presses downward against the pressure applicator 76', which, in turn, applies pressure to the heater platen 70' causing the heater platen 70' to be pressed downward into the sealing position.

Figure 18:
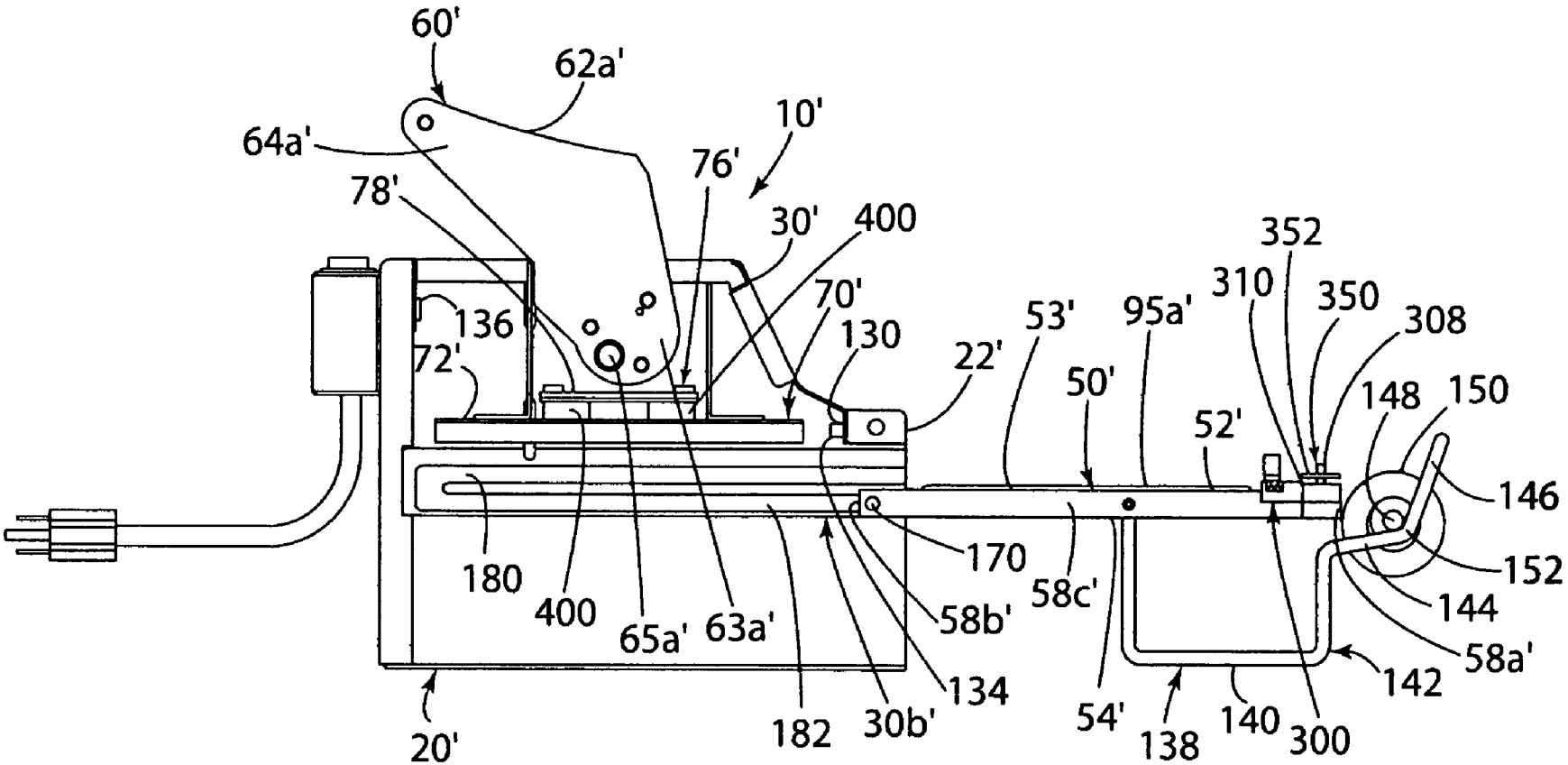
FIG. 18 is a side view of the second embodiment of the apparatus in a loading position and with one side wall removed to show details of the apparatus.
Figures 19, 19A:
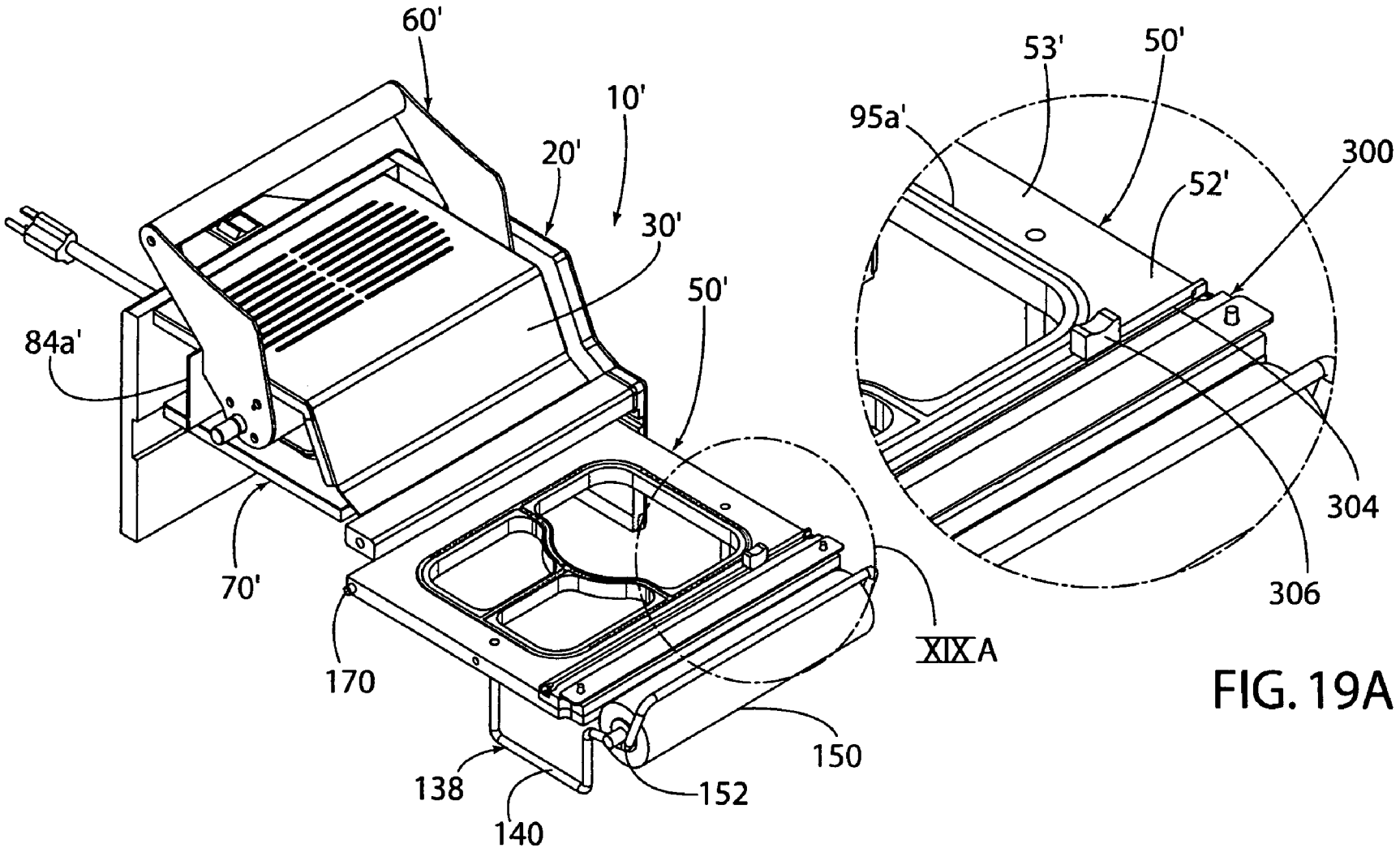
FIG. 19 is a perspective view of the second embodiment of the apparatus in a loading position and with one side wall removed to show details of the apparatus.
FIG. 19A is a perspective view of enlarged section XIXA of FIG. 19.
Figure 20:
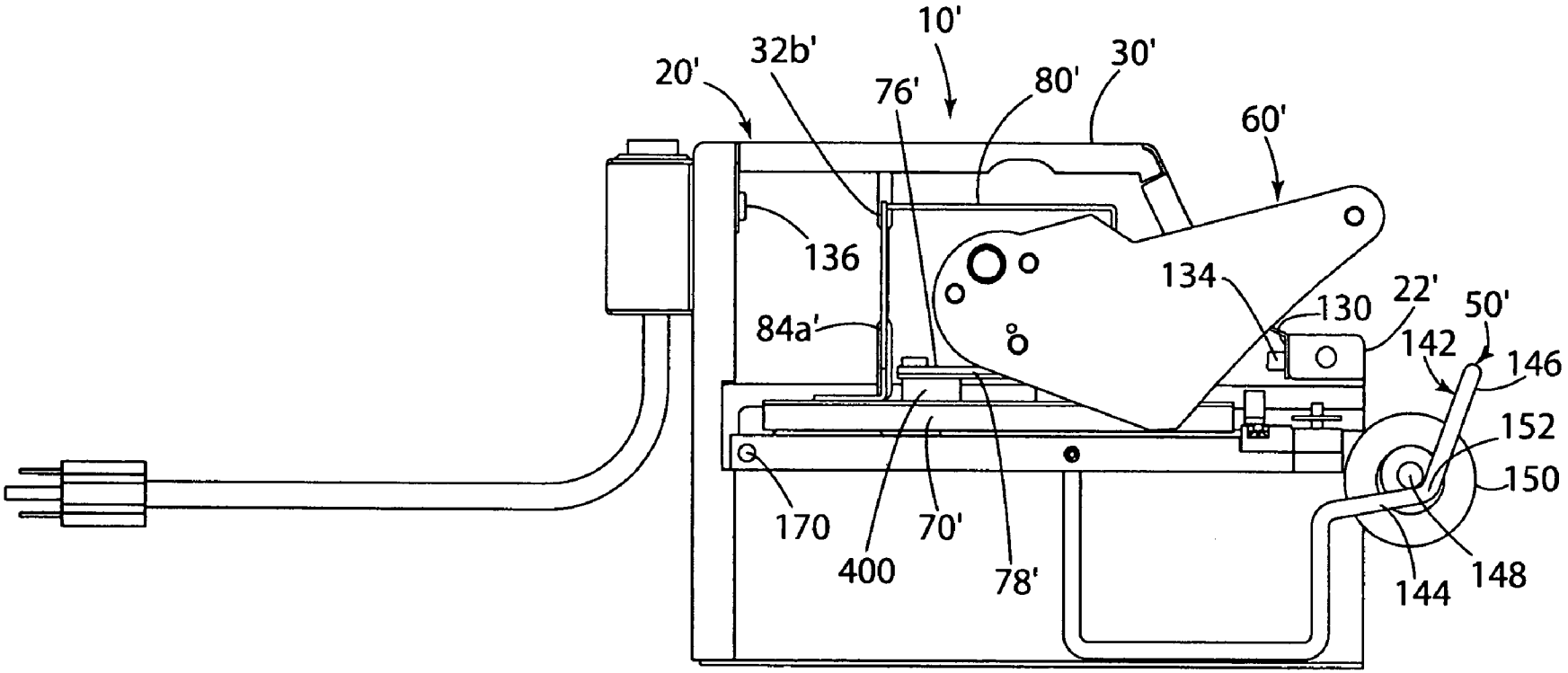
FIG. 20 is a side view of the second embodiment of the apparatus in a sealing position and with one side wall removed to show details of the apparatus.
Figure 21:
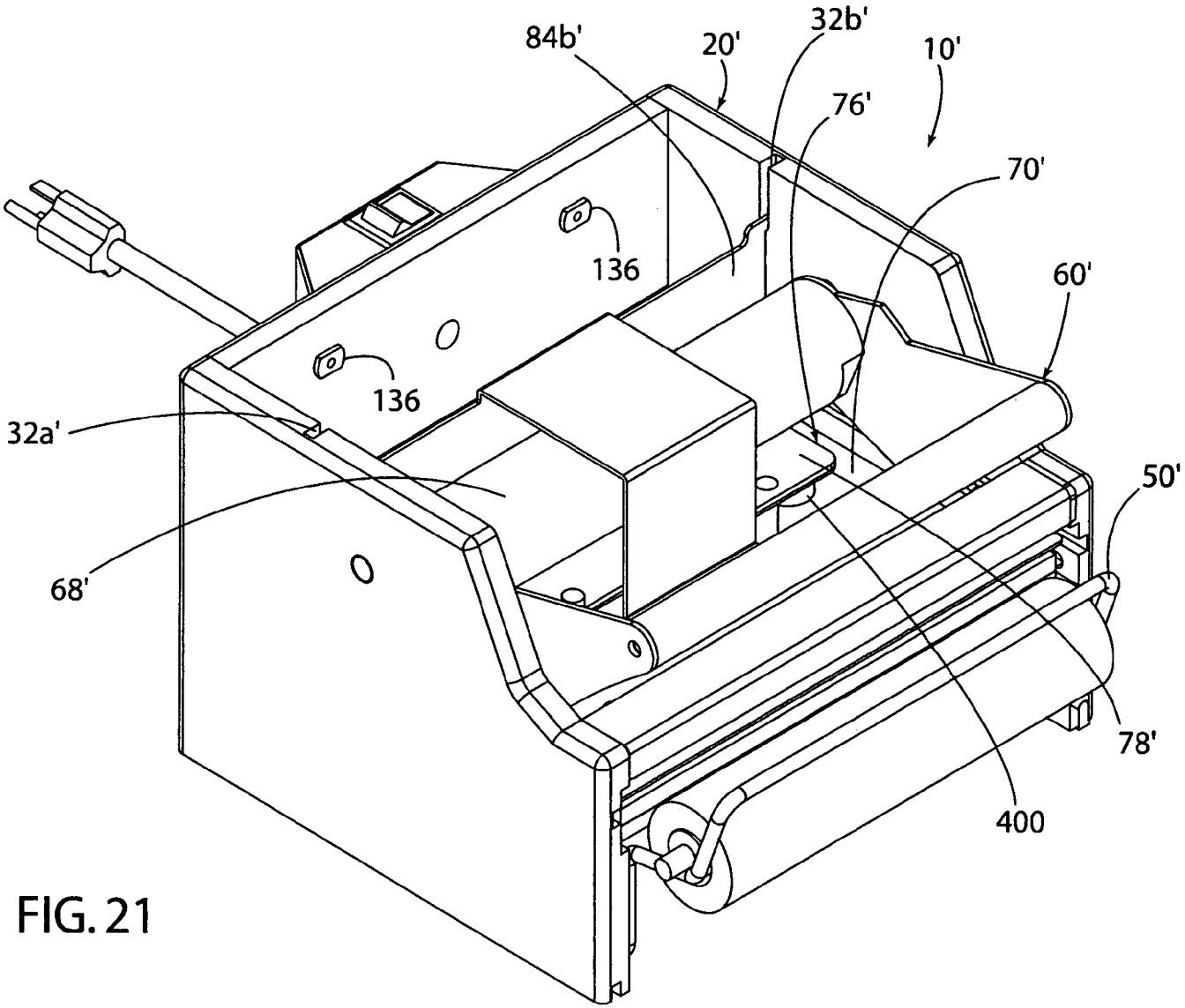
FIG. 21 is a perspective view of the second embodiment of the apparatus in a sealing position and with a lid removed to show details of the apparatus.
Figure 22:
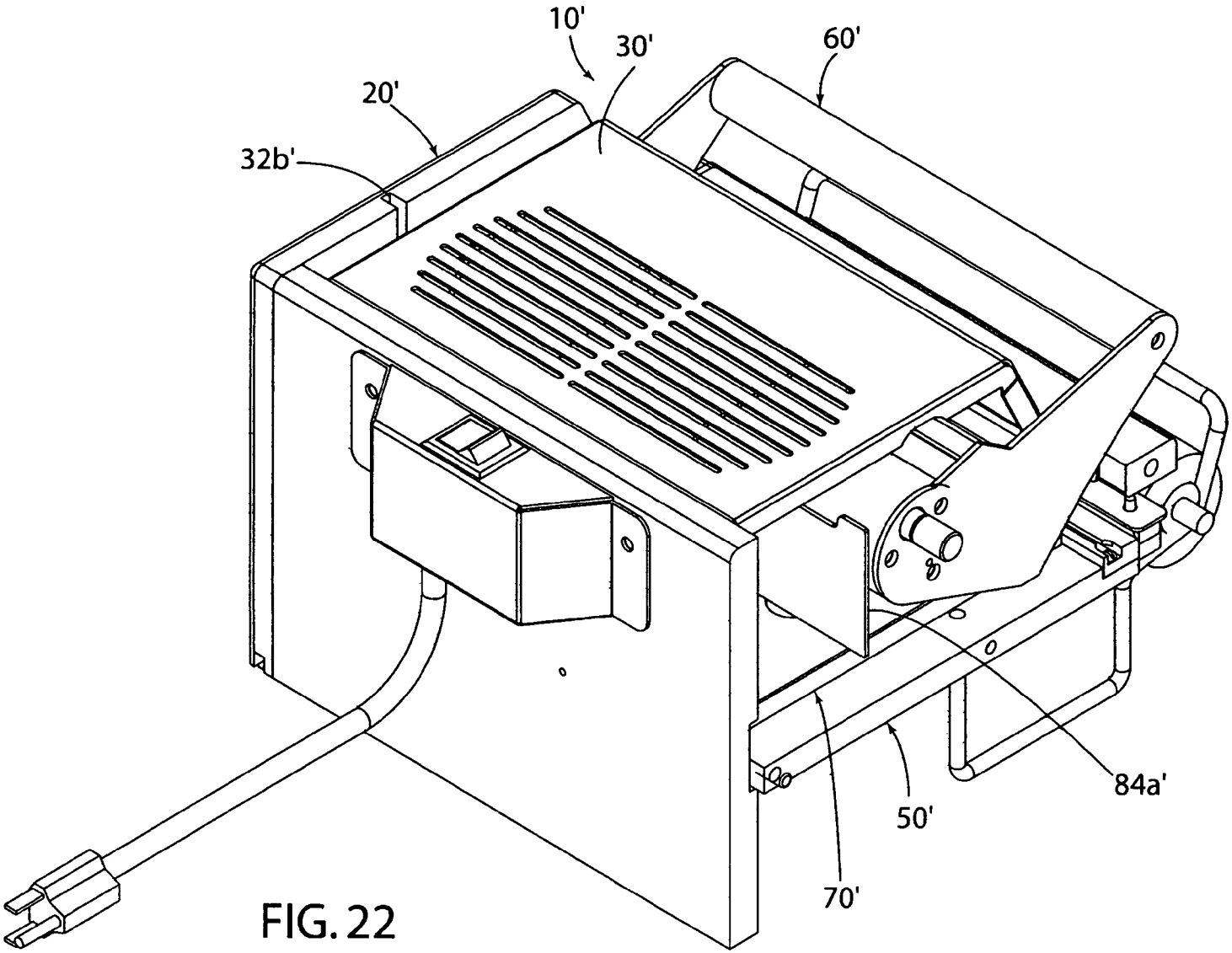
FIG. 22 is a rear perspective view of the second embodiment of the apparatus in a sealing position and with one side wall removed to show details of the apparatus.
Figure 23:
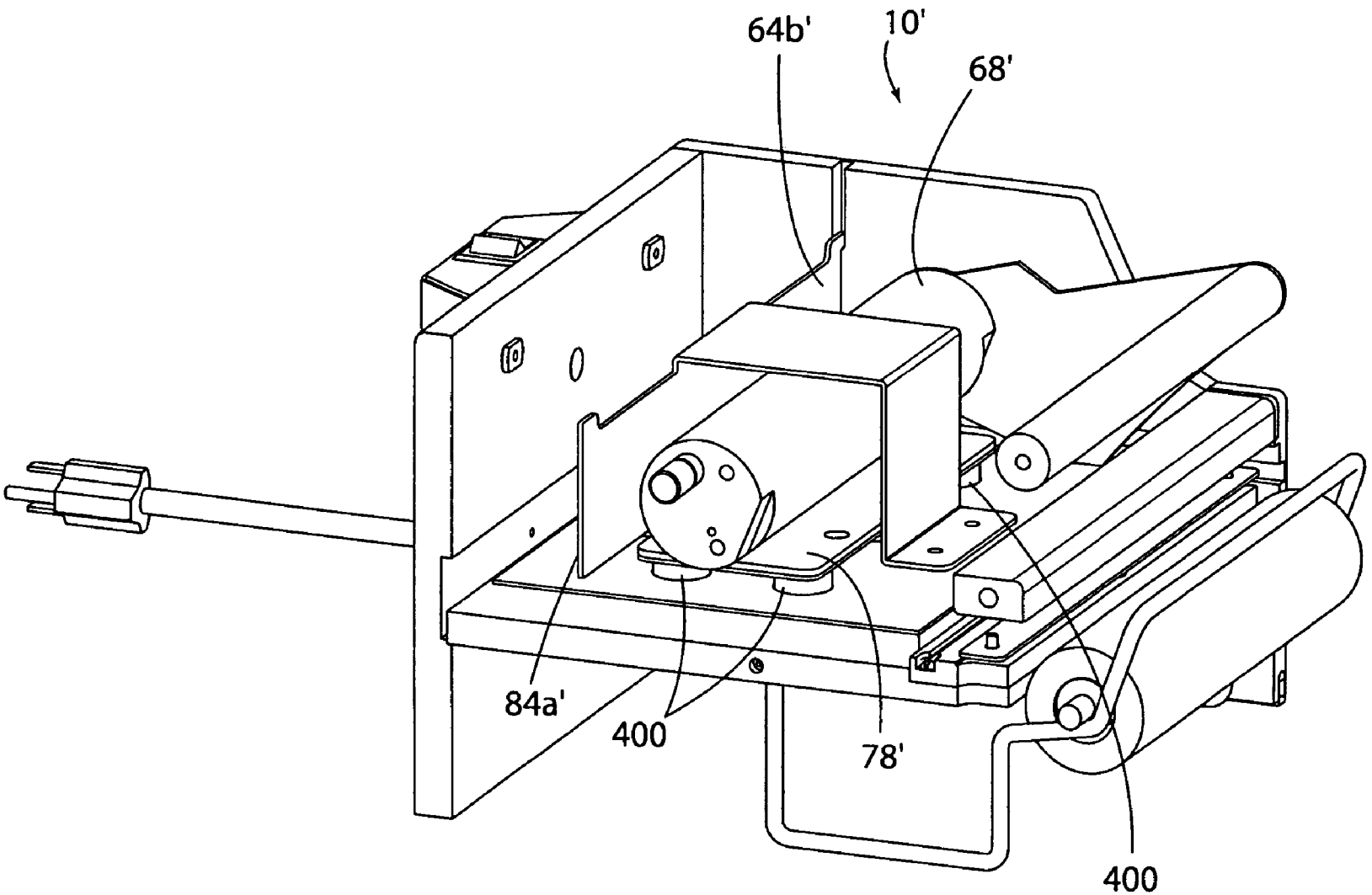
FIG. 23 is a perspective view of the second embodiment of the apparatus in a sealing position and with a lid and one side wall removed to show details of the apparatus.

As shown in FIGS. 16, 18, 20, 21 and 23, the apparatus 10' may further comprise a bracket 80' mounted to the heater platen 70'. The bracket 80' may include a horizontal member 82' that extends over the cam 68'. As best shown in FIGS. 16 and 18, as the handle 60' is rotated back to the loading position, the cam 68' engages the bottom surface of the horizontal member 82' of the bracket 80' to thereby lift the heater platen 70' from the sealed food container.

The apparatus may further include a pair of guides 84*a*' and 84*b*' extending vertically from opposite sides of heater platen 70'. As shown in FIGS. 18-23, the guides 84*a*' and 84*b*' are provided on vertical side edges of the bracket 80'. The guides 84*a*' and 84*b*' serve to guide the heater platen 70' vertically within the base 20' as described further below.

The illustrated side panels 26*a*' and 26*b*' of the base 20' may each have elongated opposing first grooves 30*a*' and 30*b*' on inner surfaces thereof. The first grooves 30*a*' and 30*b*' are U-shaped (see FIG. 18) and include an upper section 180 that extends substantially horizontally and open to a front of the base 20' to receive pins 170 extending from the side edges 58*c*' and 58*d*' of the container holder 50' such that the container holder 50' is horizontally slidable within the base 20' along the upper section. The first grooves 30*a*' and 30*b*' also include a lower section 182 that extends substantially horizontally below the upper section 180 and that does not open to a front of the base 20'. When the container holder 50' is inserted into the upper section 180 of the first grooves

30*a*' and 30*b*', the container holder 50' is moved to a rear of the first grooves 30*a*' and 30*b*', wherein the pins 170 will fall to the lower section 182 of the first grooves 30*a*' and 30*b*'. Since the lower section 182 of the first grooves 30*a*' and 30*b*' do not open to the front of the base 20', the container holder 50' will remain connected to the base 20' until the container holder 50' is fully inserted into the base 20' and a rear of the container holder 50' is lifted to move the pins 170 to the upper section 180 of the first grooves 30*a*' and 30*b*' to allow removal of the container holder 50'. The first grooves 30*a*' and 30*b*' also support the container holder 50' within the base 20' as the heater platen 70' is pressed downward against the food container and film.

In the illustrated example, the side panels 26*a*' and 26*b*' of the base 20' each may also have elongated opposing second grooves 32*a*' and 32*b*' on inner surfaces thereof. The second grooves 32*a*' and 32*b*' extend substantially vertically to receive the guides 84*a*' and 84*b*' such that the guides 84*a*' and 84*b*', the bracket 80', and the heater platen 70' are vertically movable within the base 20' above the container holder 50' when in the sealing position. As described further below, the second grooves 32*a*' and 32*b*' open to the top of the base 20' such that, during manufacture, the bracket 80' may easily be slid into the base 20' from the top (with the lid 30' removed).

Figure 24:
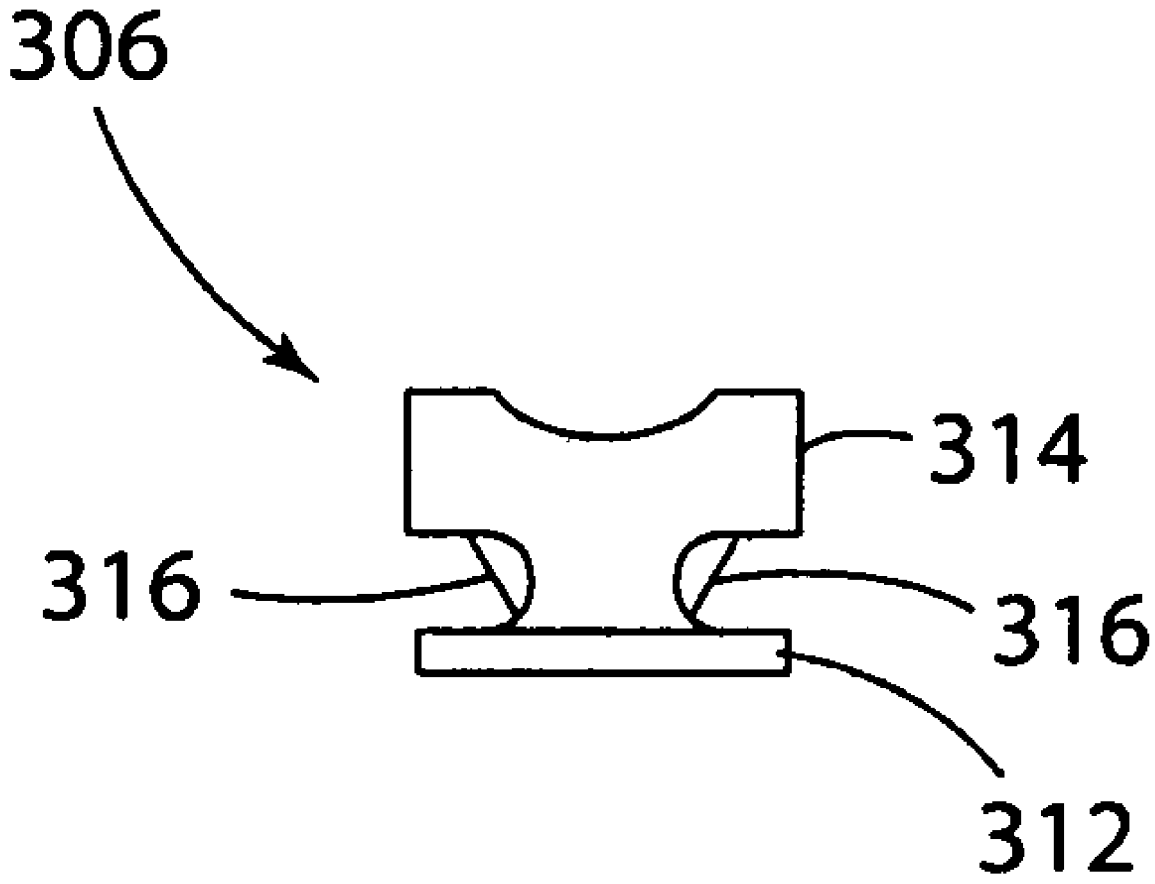
FIG. 24 is a front view of a cutting blade holder of the second embodiment of the apparatus.

The illustrated apparatus 10' may also include a cutting blade bracket 300 connected to the container holder 50'. The cutting blade bracket 300 is connected to a front of the metal plate 52'. The cutting blade bracket 300 includes a groove 304 for accepting a cutting blade holder 306 therein. The cutting blade holder 306 (FIG. 24) includes an enlarged bottom support 312 located in the groove 304, a push portion 314 and a pair of cutting blades 316. The enlarged bottom support 312 maintains the cutting blade holder 306 in the groove 304 (which preferably includes closed ends such that the cutting blade holder 306 is not allowed to slide out of the groove 304). After the film has been sealed to the container 200, the cutting blade holder 306 is slid within the groove 304 by pushing or pulling the push portion 314 and one of the cutting blades 316 will cut the film. Since the cutting blade holder 306 includes two oppositely facing cutting blades 316, the cutting blade holder 306 can be slid in two directions within the groove 304 to cut the film.

In the illustrated embodiment, the apparatus 10' may also include a hold down device 350 for holding an end of the film. The hold down device 350 is located in front of the cutting blade bracket 300 on the container holder 50' and includes a pair of upstanding posts 308 and a hold down plate 352. The cutting blade bracket 300 and the posts 308 are separated by a step 310 (see FIG. 18), with the posts 308 of the hold down device 350 being located below the groove 304 of the cutting blade bracket 300. The hold down plate 352 includes a pair of openings for accepting the posts 308 therein. During use, before the film is sealed to the container 200, the film is initially rolled over the container 200. The hold down plate 352 is then placed on top of the film, with the hold down plate 352 accepting the posts 308. After sealing, the cutting blade holder 306 is slid as discussed above to cut the film. Once the film is cut, an end of the film will raise because the end of the film is located above the step 310 and a portion of the film adjacent the end is located below the step 310 and the hold down plate 352 will force the portion downward, thereby bending the end of the film upward at the step 310.

The illustrated pressure applicator 76' may include a metal plate 78' placed between the cam 68' and a plurality of springs 400, which in turn abut against a top of the heater platen 70'. The pressure applicator 76' is preferably mounted on the heater platen 70' to apply pressure to a central portion of the heater platen 70'. During use, the handle 60' is rotated downward, thereby engaging the cam 68' with the metal plate 78'. The metal plate 78' thereafter compresses the springs 400, forcing the heater platen 70' downward and into engagement with the sealing film on the container to seal the film to the container. The handle 60' preferably comes to an end of rotation downward when the heater platen 70' is properly engaged with the film.

Although a particular embodiment has been shown in the drawings and described above that includes specific combinations of novel components, it will be appreciated by those skilled in the art that various components may be replaced with prior or future components. For example, container holder 50 or 50' may be replaced with the container holder disclosed in commonly assigned U.S. Pat. No. 5,791,120, the entire disclosure of which is incorporated herein by reference. Similarly, the heater platens, pressure applicators, base frames, handles, and/or cutting devices of any of the devices disclosed in U.S. Pat. Nos. 5,784,858; 5,946,887; 6,499,271; 6,571,534; and 6,681,546 may be used in place of the corresponding components in the embodiment described above. The entire disclosures of U.S. Pat. Nos. 5,784,858; 5,946,887; 6,499,271; 6,571,534; and 6,681,546 are incorporated herein by reference. Further, a different cutting blade whereby the cutting blade is wiped across the sealing film may be employed in the present invention.

It will further be appreciated that the sealing devices disclosed in U.S. Pat. Nos. 5,784,858; 5,946,887; 6,499,271; 6,571,534; and 6,681,546 and other sealing devices may also be modified in part to include one or more of the inventive features of the present invention.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

We claim:

1. An apparatus for sealing food containers using a sealing film, the apparatus comprising:

a base;

a container holder for holding a food container, the container holder is configured to be moved relative to the base between a loading position and a sealing position;

a heater platen positioned within the base;

a handle rotatably attached to the base to rotate between a loading position and a sealing position, the handle having a cam within the base; and a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position;

the container holder including a curved section configured to hold a roll of the sealing film such that a portion of the sealing film may be unrolled and pulled over the food container.

2. The apparatus of claim 1, wherein:

the pressure applicator applies pressure to a central portion of the heater platen.

3. The apparatus of claim 2, wherein;

the pressure applicator includes at least one spring applying resilient pressure to the heater platen.

4. An apparatus for sealing food containers using a sealing film, the apparatus comprising:

a base;

a container holder for holding a food container, the container holder is configured to be moved relative to the base between a loading position and a sealing position;

heater platen positioned within the base;

a handle rotatably attached to the base to rotate between a loading position and a sealing position, the handle having a cam within the base;

a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position; and a bracket mounted on the heater platen for extending over the cam;

wherein as the handle is rotated to the loading position, the cam engages the bracket to thereby lift the heater platen from the sealed food container.

5. The apparatus of claim 1, wherein:

the handle comprises a pair of side arms each having a base end and a distal end, the handle further comprising a handle member extending between the distal ends of the side arms, the base ends of the side arms being held to the base by a pair of pins aligned on a common axis such that the handle may be rotated about the common axis.

6. The apparatus of claim 5, wherein:

the cam is positioned between the base ends of the side arms.

7. An apparatus for sealing food containers using a sealing film, the apparatus comprising:

a base;

a container holder for holding a food container, the container holder is configured to be moved relative to the base between a loading position and a sealing position;

a heater platen positioned within the base;

a handle rotatably attached to the base to rotate between a loading position and a sealing position, the handle having a cam within the base; and a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position;

the handle comprising a pair of side arms each having a base end and a distal end, the handle further comprising a handle member extending between the distal ends of the side arms, the base ends of the side arms being held to the base by a pair of pins aligned on a common axis such that the handle may be rotated about the common axis; and the cam being positioned between the base ends of the side arms;

wherein the cam is a cylinder having a central axis, and wherein the cam is mounted between the base ends of the side arms such that the central axis of the cylinder is parallel to, but not coaxial with, the common axis whereby the cylinder is rotated about the common axis as the handle is rotated.

8. The apparatus of claim 6, wherein:

the cam has an eccentric cross section.

9. The apparatus of claim 1, wherein:

the base comprises two substantially vertical side panels, wherein the cam is mounted between the side panels.

10. An apparatus for sealing food containers using a sealing film, the apparatus comprising:

a base;

a container holder for holding a food container, the container holder is configured to be moved relative to the base between a loading position and a sealing position;

a heater platen positioned within the base;

a handle rotatably attached to the base to rotate between a loading position and a sealing position, the handle having a cam within the base;

a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position;

the base comprising two substantially vertical side panels, wherein the cam is mounted between the side panels; and a pair of guides extending vertically from opposite sides of the heater platen, the side panels of the base each have elongated opposing grooves on inner surfaces thereof, the opposing grooves extending substantially vertically to receive the guides such that the guides and the heater platen are vertically slidable within the base.

11. The apparatus of claim 9, wherein:

the side panels each have elongated opposing grooves on inner surfaces thereof, the opposing grooves extending substantially horizontally and opening to a front of the base to receive side edges of the container holder such that the container holder is horizontally slidable within the base.

12. The apparatus of claim 11, wherein:

the opposing grooves are U-shaped with one leg of each groove opening to a front of the base to allow the container holder to be slid therein, with the container holder dropping to the other leg of each groove when the container holder is fully inserted into the base.

13. An apparatus for sealing food containers using a sealing film, the apparatus comprising:

a base;

a container holder for holding a food container, the container holder is configured to be moved relative to the base between a loading position and a sealing position;

a heater platen positioned within the base;

a handle rotatably attached to the base to rotate between a loading position and a sealing position, the handle having a cam within the base;

a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position;

the base comprising two substantially vertical side panels, wherein the cam is mounted between the side panels;

the side panels each having elongated opposing grooves on inner surfaces thereof, the opposing grooves extending substantially horizontally and opening to a front of the base to receive side edges of the container holder such that the container holder is horizontally slidable within the base; and a pair of guides extending vertically from opposite sides of the heater platen, the side panels of the base each having elongated opposing grooves on inner surfaces thereof extending substantially vertically to receive the guides such that the guides and the heater platen are vertically movable within the base above the container holder.

14. The apparatus of claim 1, wherein:

the heater platen comprises a metal plate and a heater blanket provided on an upper surface of the metal plate.

15. An apparatus for sealing food containers using a sealing film, the apparatus comprising:

a base;

a container holder for holding a food container, the container holder is configured to be moved relative to the base between a loading position and a sealing position;

a heater platen positioned within the base;

a handle rotatably attached to the base to rotate between a loading position and a sealing position, the handle having a cam within the base; and a pressure applicator positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position;

wherein the container holder comprises a metal sheet having top and bottom surfaces and at least one opening through the metal sheet circumscribed by an inner edge extending between the top and bottom surfaces, the container holder further comprising a resilient gasket having a thickness greater than that of the metal sheet and having a groove formed therein for receiving the inner edge so as to contact both the top and bottom surfaces of the metal sheet and to line the opening to provide an upper support surface above the top surface of the metal sheet upon which portions of the food container are supported, the supported portions of the food container corresponding to locations where the sealing film is to be sealed to the food container.

16. The apparatus of claim 1, wherein:

the container holder comprises a sheet having top and bottom surfaces and at least one opening through the sheet.

17. The apparatus of claim 16, wherein:

the container holder includes legs extending from the sheet to support the container holder on a surface.

18. The apparatus of claim 1, wherein:

the container holder includes a hold down for holding down an end of the sealing film, the hold down being located adjacent a step such that the end of the sealing film is flipped upward against the hold down and the step.

19. The apparatus of claim 1, further comprising:

a cutting blade mounted to the heater platen for cutting the sealing film when the heater platen engages the sealing film.

20. The apparatus of claim 1, further comprising:

a cutting blade mounted to the container holder for cutting the sealing film.

21. The apparatus of claim 20, wherein:

the cutting blade is slidable in two directions along the container holder and configured to cut the sealing film as the cutting blade is slid in each direction.

22. An apparatus for sealing food containers using a sealing film, the apparatus comprising:

a base;

a container holder for holding a food container, the container holder is configured to hold a roll of the sealing film such that a portion of the sealing film may be unrolled and pulled over the food container;

a heater platen positioned within the base; and a pressure applicator positioned on a surface of the heater platen wherein the pressure applicator applies pressure to the heater platen causing the heater platen to move into engagement with the sealing film to thereby seal the sealing film to portions of the food container;

wherein the container holder is configured to be moved relative to the base between a loading position and a sealing position.

23. An apparatus for sealing food containers using a sealing film, the apparatus comprising:

a base;

a container holder for holding a food container, the container holder is configured to hold a roll of the sealing film such that a portion of the sealing film may be unrolled and pulled over the food container;

a heater platen positioned within the base; and a pressure applicator positioned on a surface of the heater platen wherein the pressure applicator applies pressure to the heater platen causing the heater platen to move into engagement with the sealing film to thereby seal the sealing film to portions of the food container;

wherein the container holder comprises a metal sheet having top and bottom surfaces and at least one opening through the metal sheet circumscribed by an inner edge extending between the top and bottom surfaces, the container holder further comprising a resilient gasket having a thickness greater than that of the metal sheet and having a groove formed therein for receiving the inner edge so as to contact both the top and bottom surfaces of the metal sheet and to line the opening to provide an upper support surface above the top surface of the metal sheet upon which portions of the food container are supported, the supported portions of the food container corresponding to locations where the sealing film is to be sealed to the food container.

24. The apparatus of claim 22, wherein:

the container holder comprises a sheet having top and bottom surfaces and at least one opening through the sheet.

25. The apparatus of claim 24, wherein:

the container holder includes legs extending from the sheet to support the container holder on a surface.

26. The apparatus of claim 22, wherein:

the container holder includes a curved section configured to hold a roll of the sealing film such that the portion of the sealing film may be unrolled and pulled over the food container.

27. An apparatus for sealing food containers using a sealing film, the apparatus comprising:

a base;

a container holder for holding a food container, the container holder is configured to hold a roll of the sealing film such that a portion of the sealing film may be unrolled and pulled over the food container;

a heater platen positioned within the base; and a pressure applicator positioned on a surface of the heater platen wherein the pressure applicator applies pressure to the heater platen causing the heater platen to move into engagement with the sealing film to thereby seal the sealing film to portions of the food container;

the container holder including a curved section configured to hold a roll of the sealing film such that the portion of the sealing film may be unrolled and pulled over the food container;

wherein the container holder includes a hold down for holding down an end of the sealing film, the hold down being located adjacent a step such that the end of the sealing film is flipped upward against the hold down and the step.

28. The apparatus of claim 22, further comprising:

a cutting blade mounted to the container holder for cutting the sealing film.

29. The apparatus of claim 28, wherein:

the cutting blade is slidable in two directions along the container holder and configured to cut the sealing film as the cutting blade is slid in each direction.

30. The apparatus of claim 22, further comprising:

a handle attached to the base to move between a loading position and a sealing position, wherein, as the handle is moved, the handle causes the pressure applicator to apply pressure to the heater platen.

31. The apparatus of claim 30, wherein:

the handle includes a cam within the base; and the pressure applicator is positioned between a portion of the cam and a surface of the heater platen whereby, as the handle is rotated, the cam rotates and presses against the pressure applicator, which, in turn, applies pressure to the heater platen causing the heater platen to move into engagement with the sealing film to thereby seal the sealing film to portions of the food container when the container holder is in the sealing position.

32. An apparatus for sealing food containers using a sealing film, the apparatus comprising:

a base;

a container holder for holding a food container;

a heater platen positioned within the base;

a pressure applicator positioned on a surface of the heater platen, wherein the pressure applicator applies pressure to the heater platen causing the heater platen to move into engagement with the sealing film to thereby seal the sealing film to portions of the food container; and a cutting blade mounted in front of the heater platen for cutting the sealing film;

the container holder including a curved section configured to hold a roll of the sealing film such that a portion of the sealing film may be unrolled and pulled over the food container; and the container holder being configured to be moved relative to the base between a loading position and a sealing position.

33. The apparatus of claim 32, wherein:

the heater platen comprises a metal plate and a heater blanket provided on an upper surface of the metal plate.

34. The apparatus of claim 32, wherein:

the container holder comprises a sheet having top and bottom surfaces and at least one opening through the sheet.

35. The apparatus of claim 34, wherein:

the container holder includes legs extending from the sheet to support the container holder on a surface.

36. An apparatus for sealing food containers using a sealing film, the apparatus comprising:

a base;

a container holder for holding a food container;

a heater platen positioned within the base;

a pressure applicator positioned on a surface of the heater platen, wherein the pressure applicator applies pressure to the heater platen causing the heater platen to move into engagement with the sealing film to thereby seal the sealing film to portions of the food container; and a cutting blade mounted in front of the heater platen for cutting the sealing film;

the container holder including a curved section configured to hold a roll of the sealing film such that a portion of the sealing film may be unrolled and pulled over the food container;

wherein the container holder includes a hold down for holding down an end of the sealing film, the hold down being located adjacent a step such that the end of the sealing film is flipped upward against the hold down and the step.

37. The apparatus of claim 32, wherein:

the cutting blade is slidable in two directions along the container holder and configured to cut the sealing film as the cutting blade is slid in each direction.

38. An apparatus for sealing food containers using a sealing film, the apparatus comprising:

a base;

a container holder for holding a food container, the container holder is configured to be moved relative to the base between a loading position and a sealing position;

a heater platen positioned within the base; and a pressure applicator positioned on the heater platen wherein the pressure applicator applies pressure to the heater platen causing the heater platen to move into engagement with the sealing film to thereby seal the sealing film to portions of the food container when the container holder is in the sealing position, wherein the pressure applicator includes a resilient member for applying resilient pressure to the heater platen;

wherein the heater platen comprises a metal plate and a heater blanket provided on an upper surface of the metal plate; and wherein the container holder includes a curved section configured to hold a roll of the sealing film such that a portion of the sealing film may be unrolled and pulled over the food container.

39. The apparatus of claim 38, further comprising:

a cutting blade mounted to the container holder for cutting the sealing film.

40. The apparatus of claim 39, wherein:

the cutting blade is slidable in two directions along the container holder and configured to cut the sealing film as the cutting blade is slid in each direction.

41. The apparatus of claim 38, wherein:

the resilient member is at least one spring.

42. An apparatus for sealing food containers using a sealing film, the apparatus comprising:

a base comprising a front panel, a rear panel, and two opposing substantially vertical side panels extending between the front panel and the rear panel;

a container holder for holding a food container, the container holder is configured to be moved relative to the base between a loading position and a sealing position, the container holder having a pair of side edges;

a heater platen positioned within the base;

a pair of guides extending vertically from opposite sides of the heater platen;

a handle movably attached to the base to move between a loading position and a sealing position; and a pressure applicator positioned on a surface of the heater platen whereby as the handle is moved, the handle causes the pressure applicator to apply pressure to a central portion of the heater platen causing the heater platen to move into engagement with the sealing film to thereby seal the sealing film to portions of the food container when the container holder is in the sealing position, wherein the side panels of the base each having elongated opposing first grooves on inner surfaces thereof, the first grooves extending substantially horizontally and opening to a front of the base to receive the side edges of the container holder such that the container holder is horizontally slidable within the base, the side panels of the base each also having elongated opposing second grooves on inner surfaces thereof, the second grooves extending substantially vertically to receive the guides such that the guides and the heater platen are vertically movable within the base above the container holder.

43. The apparatus of claim 42, further comprising:

a bracket mounted on the heater platen for extending over the cam;

wherein as the handle is rotated to the loading position, the cam engages the bracket to thereby lift the heater platen from the sealed food container.

44. The apparatus of claim 42, wherein:

the container holder comprises a sheet having top and bottom surfaces and at least one opening through the sheet.

45. The apparatus of claim 44, wherein:

the container holder includes legs extending from the sheet to support the container holder on a surface.

46. The apparatus of claim 42, wherein:

the container holder includes a curved section configured to hold a roll of the sealing film such that a portion of the sealing film may be unrolled and pulled over the food container.

47. The apparatus of claim 46, wherein:

the container holder includes a hold down for holding down an end of the sealing film, the hold down being located adjacent a step such that the end of the sealing film is flipped upward against the hold down and the step.

48. The apparatus of claim 42, wherein:

the heater platen comprises a metal plate and a heater blanket provided on an upper surface of the metal plate.

49. The apparatus of claim 42, further comprising:

a cutting blade mounted to the heater platen for cutting the sealing film when the heater platen engages the sealing film.

50. The apparatus of claim 42, further comprising:

a cutting blade mounted to the container holder for cutting the sealing film.

51. The apparatus of claim 50, wherein:

the cutting blade is slidable in two directions along the container holder and configured to cut the sealing film as the cutting blade is slid in each direction.

52. The apparatus of claim 42, wherein;

the pressure applicator includes at least one spring applying resilient pressure to the heater platen.

* * * * *

UNITED STATES PATENT AND TRADEMARK OFFICE

CERTIFICATE OF CORRECTION

PATENT NO. : 7,370,455 B2
APPLICATION NO. : 10/567885
DATED : May 13, 2008
INVENTOR(S) : Kevin J. Dewey et al.

It is certified that error appears in the above-identified patent and that said Letters Patent is hereby corrected as shown below:

Column 13, claim 4, line 13;
Before "heater" insert --a--.

Signed and Sealed this

Twenty-first Day of October, 2008

JON W. DUDAS
*Director of the United States Patent and Trademark Office*